US007770586B2

(12) United States Patent
Tojo et al.

(10) Patent No.: US 7,770,586 B2
(45) Date of Patent: Aug. 10, 2010

(54) HAIR INSERTING TOOL

(75) Inventors: Takehiko Tojo, Tochigi (JP); Hideo Kobayashi, Tochigi (JP); Hisashi Misumi, Tochigi (JP)

(73) Assignee: Kao Corporation, Tokyo (JP)

( * ) Notice: Subject to any disclaimer, the term of this patent is extended or adjusted under 35 U.S.C. 154(b) by 1337 days.

(21) Appl. No.: 10/542,357

(22) PCT Filed: Jan. 15, 2004

(86) PCT No.: PCT/JP2004/000226

§ 371 (c)(1),
(2), (4) Date: Jul. 14, 2005

(87) PCT Pub. No.: WO2004/062421

PCT Pub. Date: Jul. 29, 2004

(65) Prior Publication Data

US 2006/0124148 A1 Jun. 15, 2006

(30) Foreign Application Priority Data

| | | |
|---|---|---|
| Jan. 15, 2003 | (JP) | 2003-006510 |
| Jan. 15, 2003 | (JP) | 2003-006511 |
| Jan. 15, 2003 | (JP) | 2003-006512 |
| Dec. 25, 2003 | (JP) | 2003-430952 |
| Dec. 25, 2003 | (JP) | 2003-430953 |
| Jan. 14, 2004 | (JP) | 2004-006627 |

(51) Int. Cl.
*A45D 2/00* (2006.01)
*A45D 19/18* (2006.01)

(52) U.S. Cl. ..... 132/222; 132/270

(58) Field of Classification Search ..... 132/222, 132/210, 223, 207, 211, 273
See application file for complete search history.

(56) References Cited

U.S. PATENT DOCUMENTS

| | | | | |
|---|---|---|---|---|
| 2,819,721 | A | 1/1958 | Zakon | |
| 3,255,765 | A | 6/1966 | Sturdivant | |
| 6,295,993 | B1 | 10/2001 | Ouellette | |
| 6,647,989 | B1 * | 11/2003 | De Benedictis | 132/210 |
| 2004/0231689 | A1 | 11/2004 | Kobayashi et al. | |

FOREIGN PATENT DOCUMENTS

| | | |
|---|---|---|
| EP | 1 417 906 A1 | 5/2004 |
| GB | 921911 | 3/1963 |
| JP | 10-6609 | 5/1935 |
| JP | 14-3721 | 3/1939 |
| JP | 54-76843 | 5/1979 |
| JP | 55-15231 | 1/1980 |
| JP | 10-192036 | 7/1998 |
| JP | 2003-093133 | 4/2003 |
| WO | 03/007752 | 1/2003 |

* cited by examiner

*Primary Examiner*—Robyn Doan
(74) *Attorney, Agent, or Firm*—Oblon, Spivak, McClelland, Maier & Neustadt, L.L.P.

(57) ABSTRACT

A hair inserter for inserting a hair bundle into a flat tubular hair holder made of a sheet in such a design that the hair bundle can be inserted therein from an upper opening at one end thereof toward a lower opening at the other end thereof. The hair inserter has a long main body having, at one end portion thereof, a hair catching part capable of catching a hair bundle and is configured to be smoothly inserted with a hair bundle caught on the hair catching part through the inside of the tubular hair holder from the opening toward the opening.

4 Claims, 32 Drawing Sheets

HAIR INSERTING TOOL

TECHNICAL FIELD

The present invention relates to a hair inserter for inserting a hair bundle through a flat tubular hair holder made of a sheet in such a design that a hair bundle can be inserted from an opening at one end thereof toward an opening at the other end thereof.

The present invention also relates to a hairdressing tool having a flat tubular hair holder made of a sheet in such a design that a hair bundle can be inserted from an opening at one end thereof toward an opening at the other end thereof and a hair inserter for inserting a hair bundle into the hair holder.

The present invention also relates to a method of permanent waving using the hair inserter.

BACKGROUND OF ART

JP-A-10-192036 discloses a hair drawer (hair inserter) for inserting hair into a hair rolling tube (hair holder). The hair drawer is a stick having a loop or a hook at one end thereof. The loop or the hook has comb teeth on part of, or the whole of, the inner circumference thereof. The publication gives no concrete description about the shape of the hook.

JP-A-2003-93133 discloses a hair inserter for inserting hair into a tubular hair holder. The hair inserter is formed of a single wire composed of pulling member and a loop-shaped hair catching part at a tip of the pulling member.

According to the hair inserters disclosed in the above prior arts, a hair bundle is passed through and caught by the loop or the hook, and the hair inserter with the hair caught is inserted in a hair holder to lead the hair through the hair holder.

However, the hair inserters of JP-A-10-192036 and JP-A-2003-93133 have no particular design for facilitating insertion of the hair inserter into the hair holder. In other words, these hair inserters are difficult of smooth insertion into the hair holder. They have poor insertability particularly when a bend portion of a hair bundle is inserted to the opening of the hair holder.

The hair drawer (hair inserter) of JP-A-10-192036 is disadvantageous in that hair is apt to slip out from the loop during the insertion process of the hair to the hair rolling tube, which makes it difficult to insert the hair in the hair rolling tube. Besides, because the hair bundle must be shifted from one hand to the other during the inserting operation of the hair bundle, the hair bundle is liable to be disordered, which impairs operationality of the hair rolling tube.

According to the hair rolling tube of JP-A-10-192036, when a hair bundle is inserted to the hair rolling tube, a counter force which has a opposite direction to the direction of the insertion is generated. The counter force hinders smooth insertion of the hair bundle to the hair rolling tube. When a hair bundle is taken into the hair rolling tube, because the hair bundle and the hair catching part (loop or hook) of the hair drawer are held by different hands, the hair rolling tube tends to slide down from the hair drawer. It impairs operationality of the hair rolling tube.

Furthermore, According to the hair drawer of JP-A-10-192036, a hair bundle can not be bent by the hair drawer and therefore the hair bundle is not smoothly inserted to the inside of the hair rolling tube. As a result, the opening edge of the hair rolling tube is messed up.

JP-A-2003-93133 discloses a hairdressing tool comprising a flat tubular hair holder made of a sheet in such a design that a hair bundle can be inserted from an opening at one end thereof toward an opening at the other end thereof and a hair inserter for inserting the hair bundle in the hair holder. According to an embodiment of that hairdressing tool, the hair holder is previously set so as to keep itself in a prescribed rolled state. According to another embodiment, the hair inserter is formed of a piece of wire and has a long and narrow pulling member and a loop-shaped hair catching part at a tip of the pulling member. According to these embodiments, a hair bundle is caught by the hair catching part of the hair inserter, and the hair inserter with the hair bundle caught thereby inserted to the hair holder and the hair bundle is released from the hair catching part. The hair bundle is thus inserted through the hair holder.

In the above-described embodiments, it is necessary to stretch (unroll) the rolled hair holder before the hair inserter with a hair bundle caught thereon is put into the hair holder and to insert the hair inserter through the hair holder. The hair inserter is formed of wire and has low stiffness, and therefore it is cumbersome and difficult to attain a smooth insertion because of the low stiffness and poor insertability of the hair inserter. Moreover, the hair inserter of insufficient stiffness fails to stretch the rolled hair holder and fails to make space inside the holder for passing the hair through.

Accordingly, an object of the present invention is to provide a hair inserter with which a hair bundle can smoothly and easily be inserted in a flat tubular hair holder and a method of permanent waving using the hair inserter.

Another object of the present invention is to provide a hairdressing tool including a hair inserter and a hair holder, which secures easy operation in inserting the hair inserter into the hair holder and with which the hair inserter can smoothly be inserted into the hair holder.

DISCLOSURE OF THE INVENTION

The present invention accomplishes the above object by providing a hair inserter for inserting a hair bundle in a hair holder having a flat tube made of a sheet in such a design that the hair bundle can be inserted from an opening at one end thereof (hereinafter referred to as an upper opening) toward an opening at the other end thereof (hereinafter referred to as a lower opening). The hair inserter has a long main body with a hair catching part at one end portion thereof, with which to catch a hair bundle. The hair inserter is configured to be smoothly inserted, with a hair bundle caught on the hair catching part, through the inside of the tube from the upper opening toward the lower opening.

The present invention also accomplished the above object by providing a hairdressing tool including a hair holder having a flat tube made of a sheet in such a design that a hair bundle can be inserted therethrough from an upper opening toward a lower opening thereof and a hair inserter for inserting the hair bundle in the hair holder. The hair holder is previously set so as to keep itself in a state rolled up into a prescribed shape. The hair inserter is adapted to be passed through the inside of the rolled tube from the upper opening to the lower opening thereby to substantially stretch the rolled holder.

The present invention also provides a method of permanent waving. According to the method, a hair bundle is inserted in a hair holder by using the hair inserter of the present invention, and the hair holder containing the hair bundle is rolled up. In this state, a permanent waving preparation is applied to the hair holder or supplied to the inside of the hair holder through the opening of the hair holder.

BEST MODE FOR CARRYING OUT THE INVENTION

The term "hook" as used in the description is a kind of hair catching part.

The hair inserter of the present invention will be described with reference to its preferred first embodiment by way of FIGS. 1 through 4. As shown in FIGS. 1 through 4, the first embodiment provides a hair inserter 1 for inserting a hair bundle H into a flat tube as a hair holder T made of a sheet in such a design that the hair bundle H can be inserted therein from an upper opening T1 toward a lower opening T2. The hair inserter 1 is composed of (1) a long main body having, at one end portion thereof, a hair catching part 6 on which the hair bundle H can be caught and (2) a space-forming member (sliding member 3) that creates a tubular space inside the tube so that the hair inserter 1 having the hair bundle H caught on the hair catching part 6 may smoothly be inserted through the tubular space from the upper opening T1 toward the lower opening T2. The hair inserter 1 is stiffer than the hair holder T.

Figure 1A:
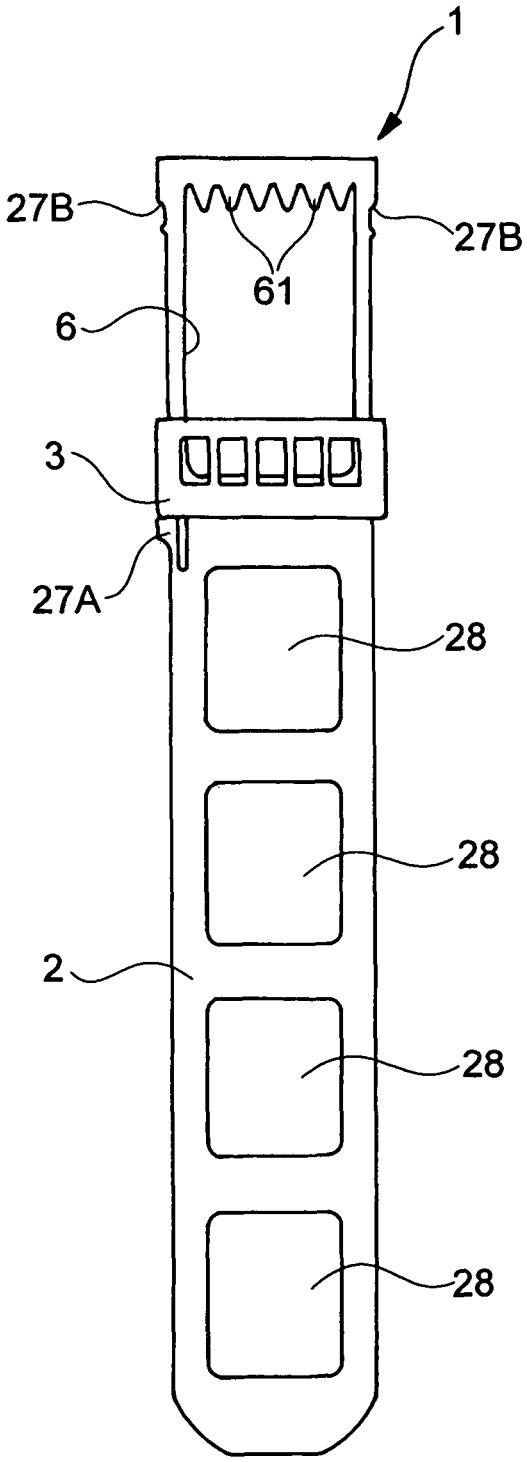
FIG. 1(*a*), FIG. 1(*b*), and FIG. 1(*c*) illustrate a first embodiment of the hair inserter according to the present invention, in which FIG. 1(*a*) is a front view, FIG. 1(*b*) a left side view, and FIG. 1(*c*) a fragmental cross-sectional view.
Figure 1B:
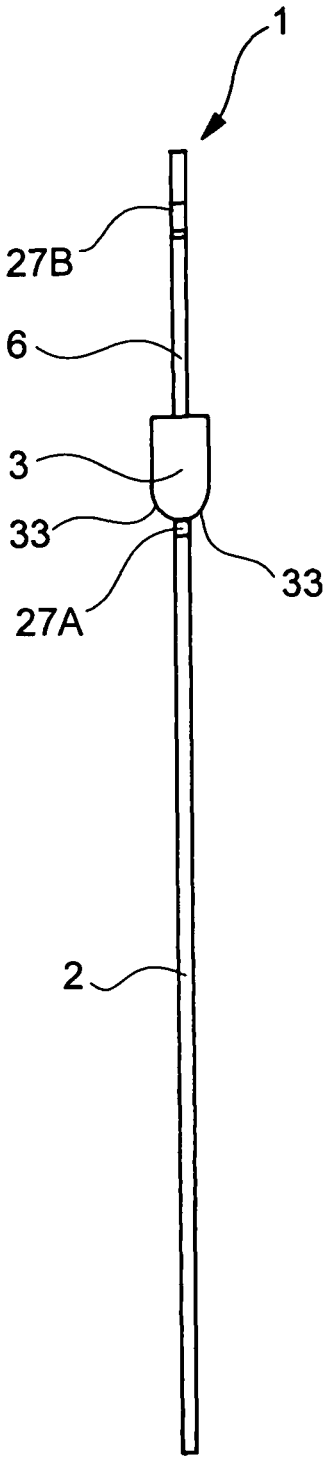
Figure 1C:
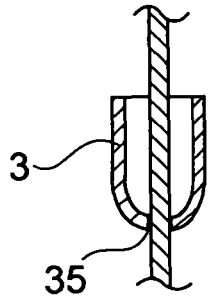

The hair inserter 1 of the first embodiment will be described further. As shown in FIGS. 1(*a*) and 1(*b*), the hair inserter 1 of the present embodiment has a plate-like member 2 as a long main body having at one end portion thereof a hair catching part 6 for catching a hair bundle H. For the sake of convenience, the end having the hair catching part 6 will be called "the upper end". The plate-like member 2 extends from about the lengthwise middle to the other end (hereinafter called "the lower end" as depicted in the figures) of the hair inserter 1. The plate-like member 2 has nearly rectangular holes 28 cut out at intervals in the longitudinal direction. The holes 28 contribute to reducing the weight, optimizing (reducing) the stiffness, reducing the material cost, improving the appearance, and the like.

A frame-shaped hair catching part 6 is provided at the upper end of the plate-like member 2. The frame as a hair catching part 6 has comb teeth 61 on the inner circumferential face of one of the sides in the width direction of the plate-like member 2. The above-described structure functions to spread a hair bundle H caught on the catching part 6 in the width direction and is especially effective in improving insertability of the hair inserter when the hair inserter is inserted to a hair holder having a low-stiffness (i.e., soft).

Figure 2:
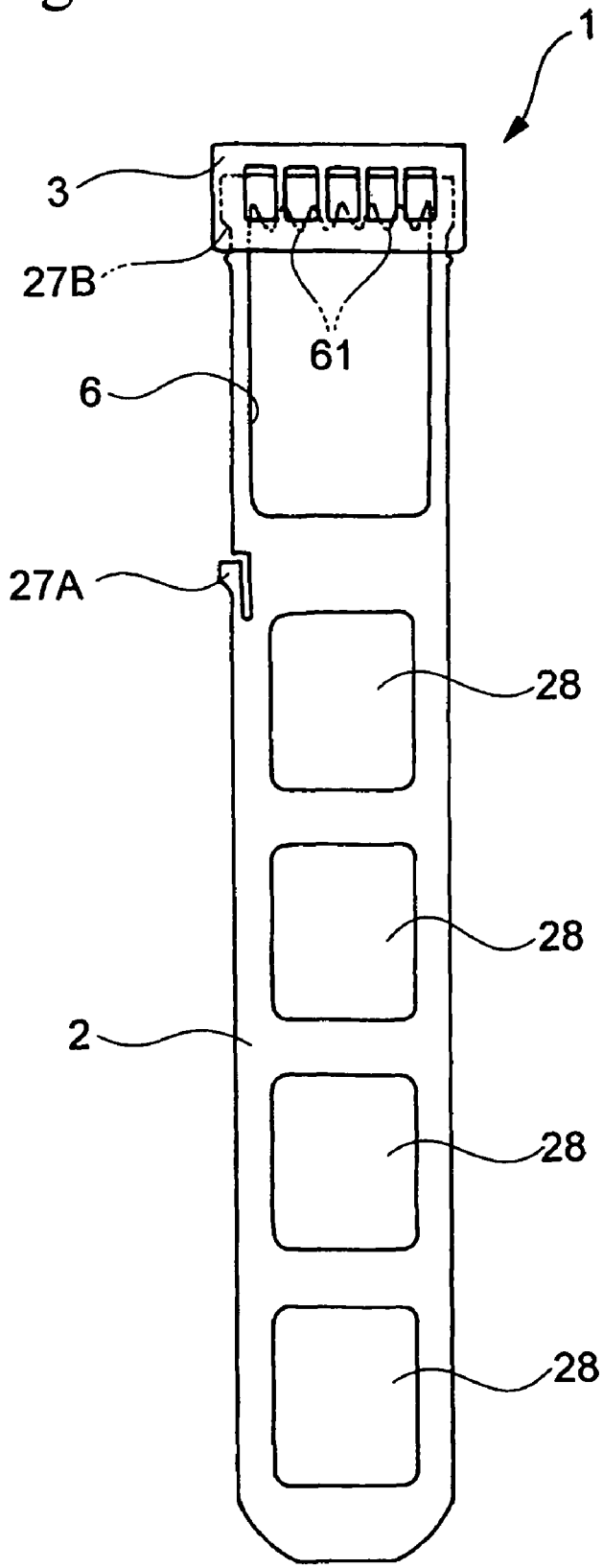
FIG. 2 shows hair inserter of the first embodiment is slid with its sliding member slid upward (corresponding to FIG. 1(*a*)).

The hair inserter 1 of the first embodiment has a sliding member 3 as a space-forming member as shown in FIGS. 1 and 2. The sliding member 3 is thicker and wider than the hair catching part 6. It is provided near the hair catching part 6 and is slidable along the longitudinal direction of the hair inserter 1. The sliding member 3 has an insertion hole 35, through which the hair catching part 6 is inserted as shown in FIG. 1(*c*). As shown in FIG. 2, when the sliding member 3 is moved to the top of the hair inserter 1, the sliding member 3 encloses the comb teeth 61 and their vicinities. When seen from the side, the sliding member 3 has its bottom corners (corners facing the lower end of the plate-like member (main body) 2) rounded in the arc of a circle as shown in FIG. 1(*b*). Accordingly, the thickness of the sliding member 3 increases smoothly from the bottom toward the upper end of the plate-like member 2.

Figure 3A:
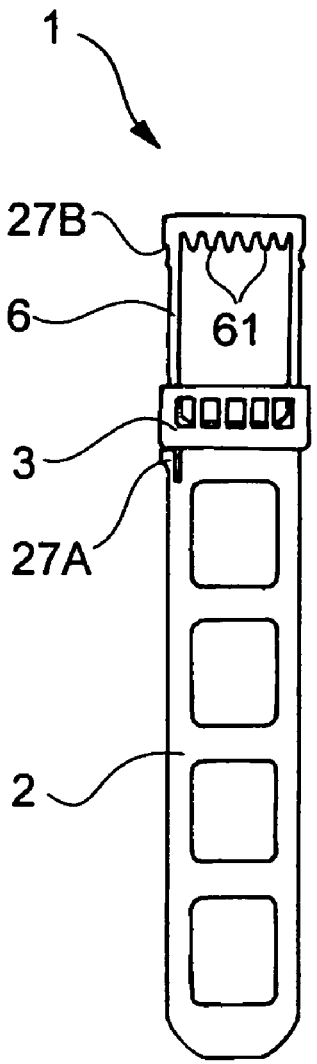
FIG. 3(*a*), FIG. 3(*b*), and FIG. 3(*c*) depict usage of the hair inserter according to the first embodiment, in which the way of catching a hair bundle in the hair inserter is illustrated in sequence.
Figure 3B:
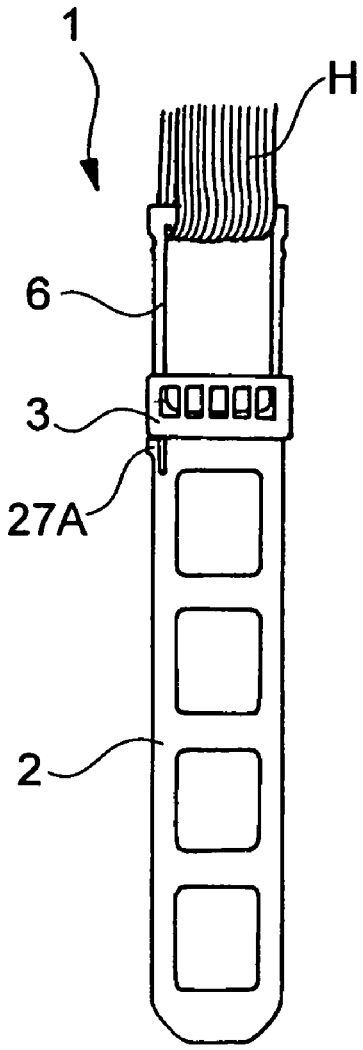
Figure 3C:
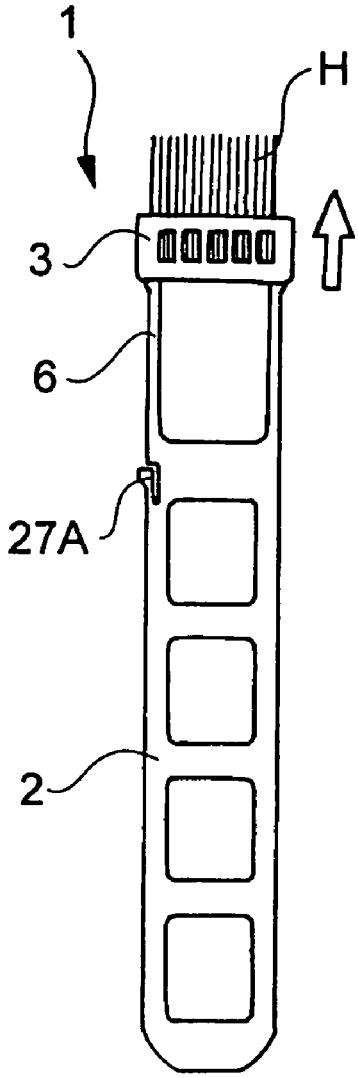

A lower stopper 27A which is projected outward is provided on one longer side edge of the hair inserter 1 and near the border between the plate-like member 2 and the hair catching part 6. An upper stopper 27B which is projected outward is provided on each longer side edge of the hair inserter 1 and near the upper end of the hair catching part 6. The sliding member 3 is allowed to slide downward until it meets the lower stopper 27A as depicted in FIG. 1(*a*) and upward until it reaches the upper stoppers 27B as illustrated in FIG. 2. According to the hair inserter 1 of the first embodiment, when the sliding member 3 is positioned at the lowest location as in FIG. 3(*a*), a hair bundle H is caught on the comb teeth 61 of the hair catching part 6 as shown in FIG. 3(*b*), and when the sliding member 3 is slid up, the hair bundle H is fixed between the hair catching part 6 and the sliding member 3 as illustrated in FIG. 3(*c*).

The main body and the space-forming member of the hair inserter of the present invention can be made by machining or molding to synthetic resin materials or machining to metallic materials. The members used in the first embodiment are made by machining to a synthetic resin material. The lower end of the hair inserter 1 is preferably rounded as shown in FIG. 1(*a*) for facilitating insertion into a hair holder. The hair inserter of the present invention has higher stiffness than a hair holder. The stiffness of the hair inserter is desirably 20 or more times, more desirably 100 or more times, that of a hair holder. The hair inserter is required to be stiffer than a hair holder at least in the lower end portion thereof. Such stiffness is not always needed all over the hair inserter.

The stiffness and Taber stiffness (hereinafter described) of a hair inserter and the stiffness of a hair holder as referred to in the present invention are evaluated in accordance with Taber stiffness measured by the Taber stiffness tester method specified in JIS P8125.

Even if a hair inserter has a member that exhibits no substantial influence to the stiffness of the hair inserter (example of the material is the sliding member 3 of the embodiment shown in FIG. 1 or the sliding member of the embodiment shown in FIG. 8 hereinafter described), measurement is made on the hair inserter without that member. Where a hair inserter does not have such a member, measurement is made on the whole of the hair inserter. The stiffness of a hair holder is evaluated in accordance with Taber stiffness measured on the whole of the tube in its flattened state by the Taber stiffness tester method.

Figure 4A:
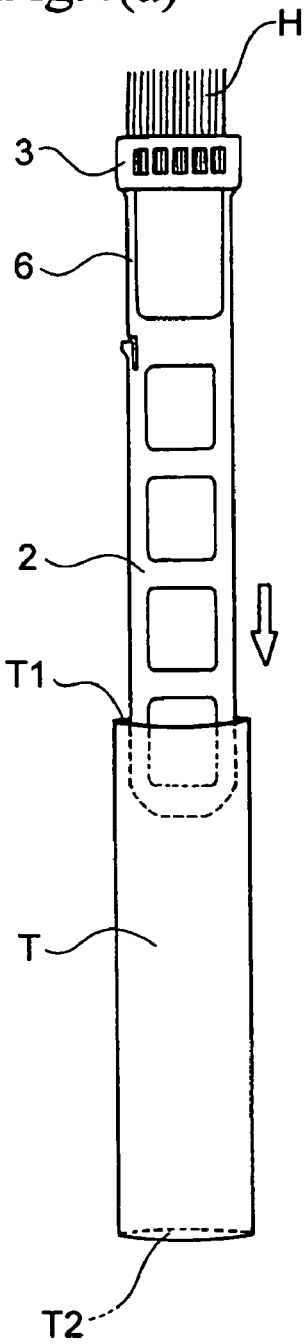
FIG. 4(*a*), FIG. 4(*b*), and FIG. 4(*c*) show usage of the hair inserter of the first embodiment, in which the way of passing the hair inserter through the hair holder is illustrated in sequence.
Figure 4B:
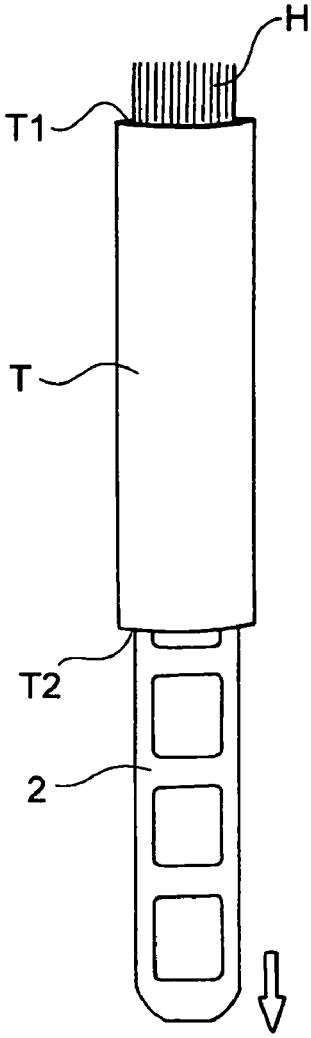
Figure 4C:
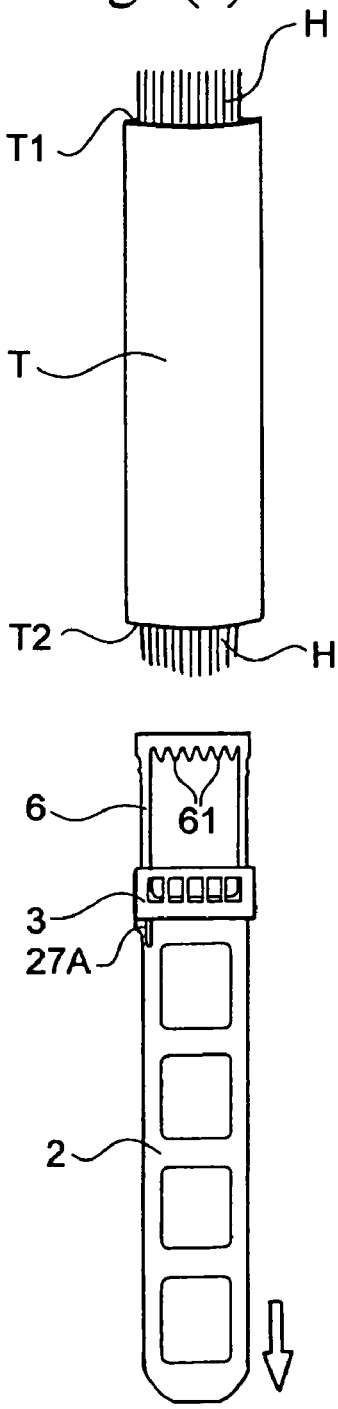

Usage of the hair inserter of the first embodiment shown in FIG. 1 is explained by referring to FIGS. 3 and 4. To begin with, the sliding member 3 is positioned at the lowest location as in FIG. 3(*a*). A hair bundle H is caught on the comb teeth 61 of the hair catching part 6 as shown in FIG. 3(*b*). The sliding member 3 is slid upward as shown in FIG. 3(*c*). The hair bundle H caught on the hair catching part 6 is thus fixedly held between the hair catching part 6 and the sliding member 3. As shown in FIGS. 4(*a*), 4(*b*), and 4(*c*), the hair inserter 1 with the hair bundle H fixed is put into the upper opening T1 of a hair holder and is drawn from the lower opening T2 of the hair holder T. It is also possible that the hair inserter is firstly set in the hair holder and then the hair bundle is caught by the hair catching part and finally the hair inserter is drawn from the hair holder to hold the hair bundle in the hair holder.

After the hair inserter 1 is passed through the hair holder T from the upper opening T1 to the lower opening T2, the hair bundle H is held in the hair holder T and the tip of the hair bundle slightly sticks out of the lower opening T2 as shown in FIG. 4(*c*). Thereafter the hair bundle can be curled in a desired style by, for example, rolling up the hair holder T. The hair bundle H in the hair holder T does not always need to have the sticking. The term "a hair bundle" as used herein includes not only a bundle of hairs but a group of a certain number of hairs that may not be seen as a bundle.

The hair inserter 1 according to the first embodiment has a sliding member thicker and wider than the hair catching part 6. The sliding member serves as a space-forming member that creates a tubular space in a tube T to help the hair inserter 1. The hair bundle is more smoothly inserted from the upper opening T1 to the lower opening T2 of the tube T due to the tubular space. Besides, the hair inserter 1 is stiffer than the hair holder T. As the sliding member 3, which encloses the hair catching part 6 and the hair bundle H caught by the hair catching part 6, proceeds into the inside of the hair holder T creating the tubular space and the hair bundle H follows the hair holder T. As a result, the hair bundle H smoothly enters and proceeds in the hair holder T without receiving a considerable resistance from the hair holder T.

In particular, since the sliding member 3 is provided slidably in the longitudinal direction of the hair inserter 1, the sliding member 3 as a space-forming member can be disposed near the bent portion of the hair bundle H, insertability of the hair bundle H is more improved. Furthermore, since the hair bundle H caught on the hair catching part 6 is fixed between the hair catching part 6 and the sliding member 3, the hair bundle H hardly slips from the hair catching part 6 while it proceeds in the hair holder T. Since the comb teeth 61 of the hair catching part 6 catch the hair bundle H thereon, and the sliding member 3 surrounds the bent portion of the hair bundle H, the combination of the comb teeth 6 and the sliding member 3 exerts a strong holding power onto the hair bundle H.

Other embodiments of the hair inserter according to the present invention will be described only with reference to differences from the first embodiment. To those particulars that are not described here, the description given to the first embodiment applies. The hair inserters according to the other embodiments are capable of smoothly inserting a hair bundle into a hair holder similarly to the one described above.

Figure 5A:
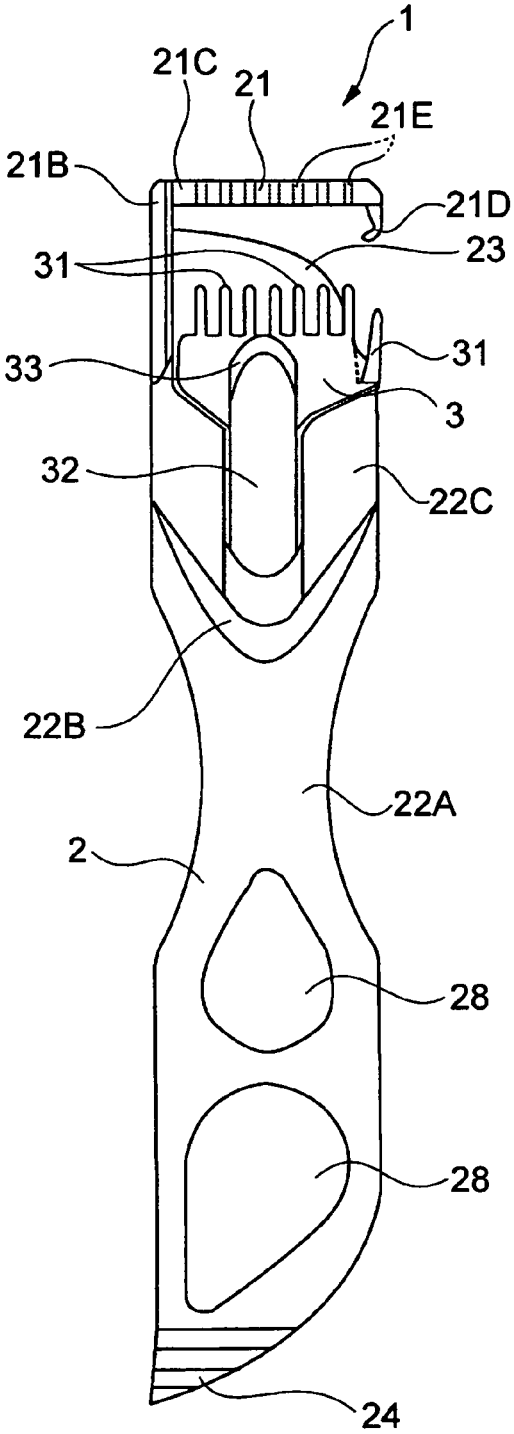
FIG. 5(*a*) and FIG. 5(*b*) show a second embodiment of the hair inserter according to the present invention, in which FIG. 5(*a*) is a front view, and FIG. 5(*b*) a back view.
Figure 5B:
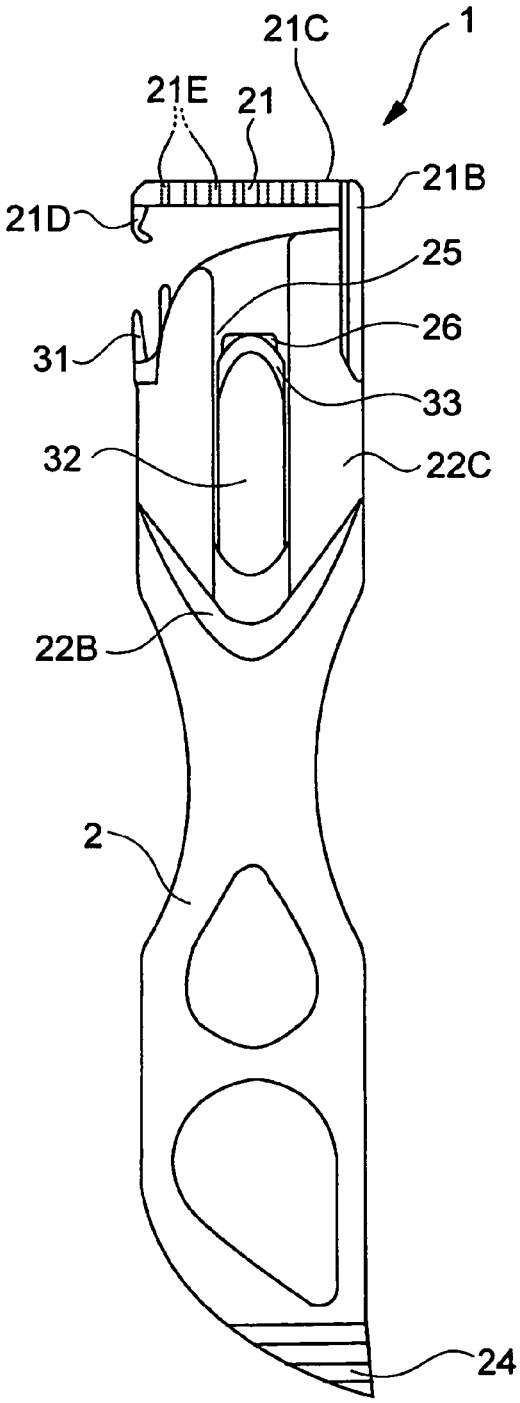
Figure 6:
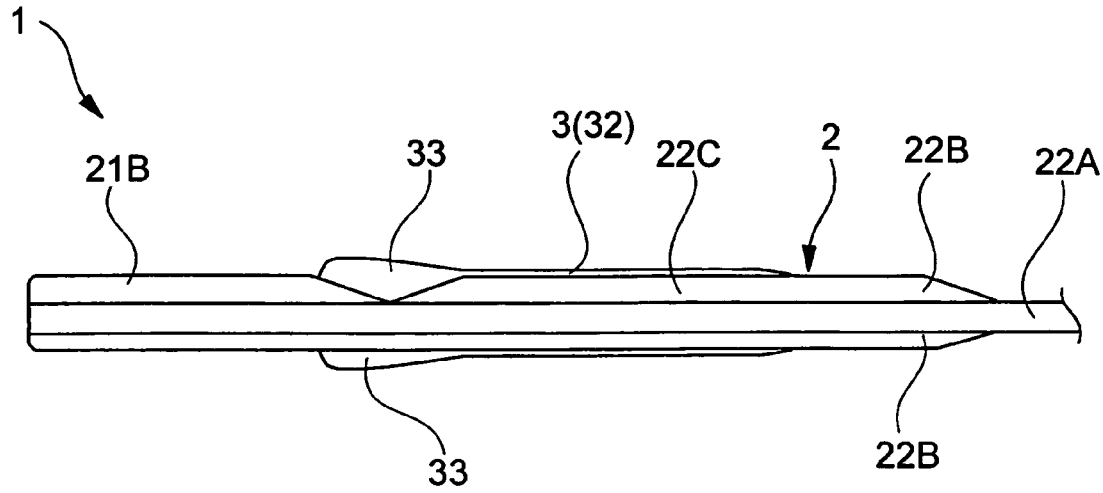
FIG. 6 is a left side view of the upper half of the hair inserter according to the second embodiment.

As illustrated in FIGS. 5 and 6, a hair inserter 1 according to the second embodiment of the invention has a hook 21 at one end (upper end) of its main body 2. The other end (lower end) 24 of the main body 2 is tapered in a 90 degree arc to facilitate insertion into a hair holder T. The main body 2 has holes 28. The holes 28 are for the same purposes as of those in the first embodiment.

The hook 21 is composed of a shank 21B, an arm 21C, and a claw 21D. The shank 21B is connected to the upper end of one of the longer sides of the main body 2 of the hair inserter 1 and extends in the longitudinal direction of the hair inserter 1. The upper end of the shank 21B connects to the arm 21C that extends in the width direction of the hair inserter 1. The extending end of the arm 21C connects to the claw 21D that projects toward the lower end of the main body 2. The arm 21C has holes 21E that are configured to receive comb teeth 31 of a sliding member 3 (described later) inserted from the side of the main body 2. A plate-like sliding support 23 that is thinner than the shank 21B is provided on the inner side edge of the shank 21B.

The area in the vicinity of the boarder between the main body 2 and the hook 21 forms a thick portion 22C that is thicker than a thin portion 22A that occupies the most part of the main body 2 as shown in FIGS. 5 and 6. The thin portion 22A and the thick portion 22C connect to each other via a sloping portion 22B where the thickness increases smoothly in the direction from the lower to the upper ends of the main body 2. The sloping portion 22B is integral with the main body 2 and serves as "a space-forming member" of the present invention. A recess 25 for sliding is provided in the thick portion 22C in the width middle portion of the hair inserter 1. The recess 25 extends in the longitudinal direction of the hair inserter 1. The recess 25 and the sliding support 23 have the same thickness and are integral with each other.

The recess 25 is provided on both sides of the thick portion 22C of the main body 2 as shown in FIGS. 5(*b*) and 7(*a*). A through-hole 26 (see FIG. 5(*b*)) is formed and it passes through the bottoms of the recesses 25 on both sides.

A sliding member 3 is provided on the upper end of the main body 2 slidably in the longitudinal direction of the hair inserter 1. The sliding member 3 is a combing member having, on the upper end thereof, comb teeth 31 pointing to the hook 21. A sliding protrusion 32 inclusive of the lower end of the sliding member 3 has its cross-section configured to engage with the recess 25 on each side of the main body 2. The sliding protrusions 32 is disposed on the recess 25 on one side and linked to that disposed on the recess 25 on the other side via the through-hole 26.

As shown in FIG. 6, the most part of the sliding protrusion 32 is thicker than the thick portion 22C of the main body 2. The sliding protrusion 32 is thickest in its upper portion 33 (the portion closer to the hook 21, designated a thickest portion 33). Thus, the sliding member 3 serves as another space-forming member in addition to the sloping portion 22B. The shank 21B of the hook 21 is substantially as thick as the thick portion 22C of the main body 2, while the arm 21C of the hook 21 is thinner than the shank 21B.

Figure 7A:
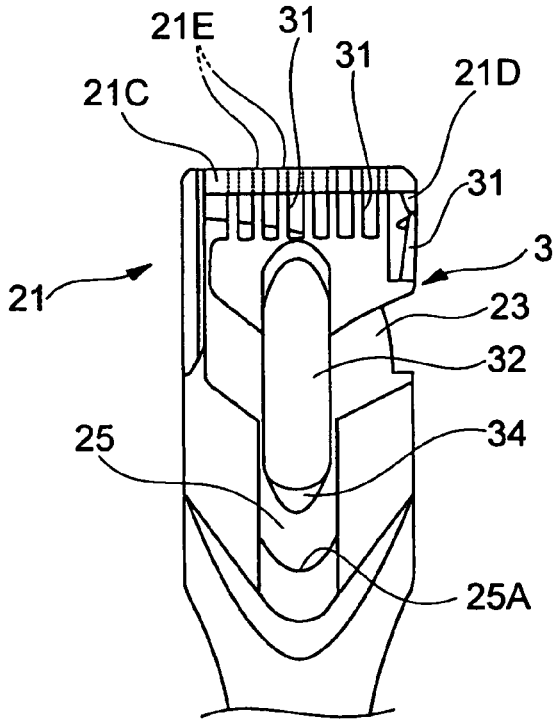
FIG. 7(*a*) and FIG. 7 (*b*) are front views of the upper half of the hair inserter according to the second embodiment (corresponding to the upper half of FIG. 5(*a*)), in which FIG. 7(*a*) shows the one with its sliding member up, and FIG. 7(*b*) shows the one with hair caught in the hook.
Figure 7B:
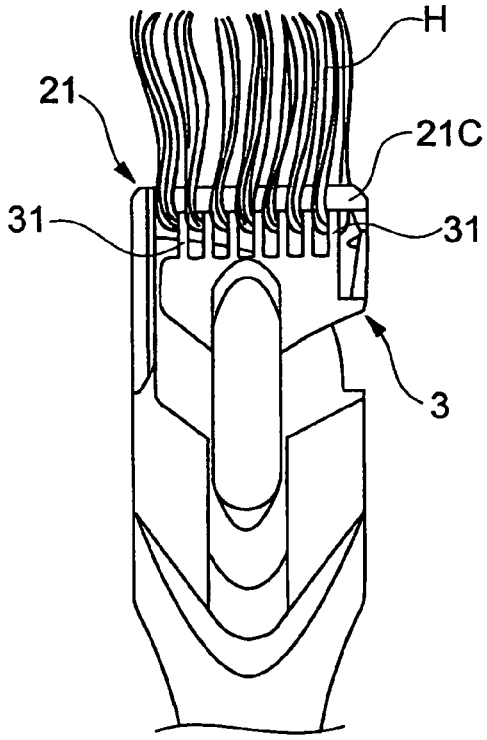

As shown in FIGS. 5(*a*) and 5(*b*), the sliding member 3 can slide down until the lower end 34 (see FIG. 7(*a*)) of the sliding protrusion 32 meets the lower end 25A of the recess 25 and slide up until the comb teeth 31 enter the holes 21E of the hook 21 as shown in FIG. 7(*a*).

The hair inserter of the second embodiment is designed to be used as follows. To start with, the sliding member 3 is positioned lowest as illustrated in FIGS. 5(*a*) and 5(*b*). In that state, a hair bundle H is caught by the hook 21, and the sliding member 3 is moved upward to fix the hair bundle H caught on the hook 21 between the hook 21 and the comb teeth 31 of the sliding member 3 as shown in FIG. 7(*b*).

The hair inserter 1 of the second embodiment is operated in the same manner as for the one of the first embodiment shown in FIG. 1 to produce the same effects as in the first embodiment in successfully inserting a hair bundle into a hair holder.

In particular, the hair inserter 1 of the second embodiment has the sloping portion 22B and the sliding member 3 both having their thickness smoothly increased in the direction from the lower to upper ends of the main body 2. More specifically, the hair inserter 1 has its thickness gradually increased from the lower end (the right hand side in FIG. 6) to the other end (the left hand side in FIG. 6), i.e., in the order of the thin portion 22A, the sloping portion 22B, and the thick portion 22C of the main body 2 and the sliding protrusion 32 and the thickest portion 33 of the sliding member 3, thereby constituting a space forming structure. Since the sliding protrusion 32 and the thickest portion 33 are thicker than the hook 21, the space forming structure performs the same function as the space-forming member (sliding member 3) of the first embodiment shown in FIG. 1.

Figure 8A:
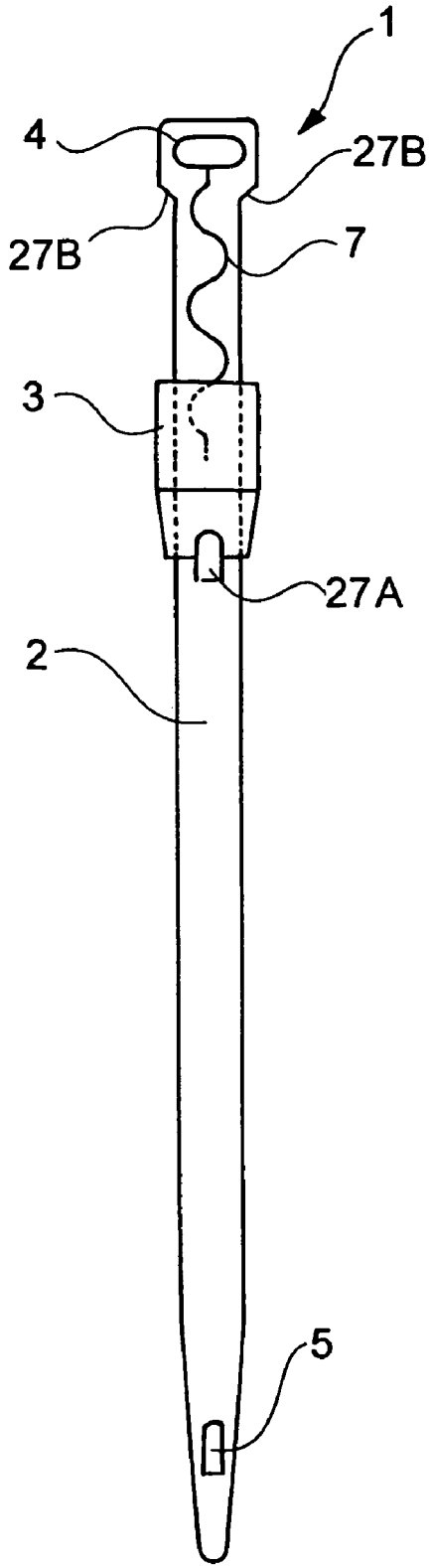
FIG. 8(*a*) and FIG. 8(*b*) show a third embodiment of the hair inserter according to the present invention, in which FIG. 8(*a*) is a front view, and FIG. 8(*b*) a left side view.
Figure 8B:
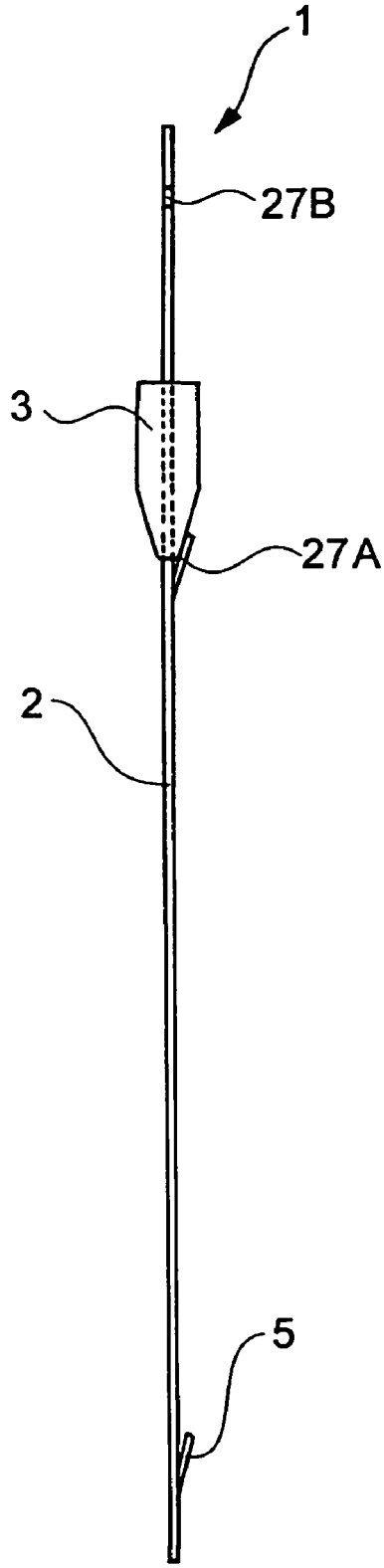

A third embodiment provides a hair inserter 1 having, as a main body and a hair catching part 7, a long and narrow plate-like member 2 with a tapered lower end as shown in FIGS. 8(*a*) and 8(*b*). The plate-like member 2 is made of a rigid synthetic resin sheet, a metal plate, etc. The plate-like member 2 in this particularly embodiment is made of a rigid synthetic resin sheet.

The plate-like member 2 has a hair catching part 7 at the upper end thereof. The hair catching part 7 is a waving slit extending in the longitudinal direction of the plate-like member 2 as shown in FIG. 8(*a*), through which a hair bundle H is to be passed and held. An almost rectangular hole 4 is formed at the upper end portion of the plate-like member 2, and the upper end of the hair catching part 7 is open to the hole 4. In the third embodiment, one of the sides surrounding the hole 4 along the width direction of the plate-like member 2 functions to spread a hair bundle H caught by the hair catching part 7 (the hole 4) in the width direction.

Figure 9A:
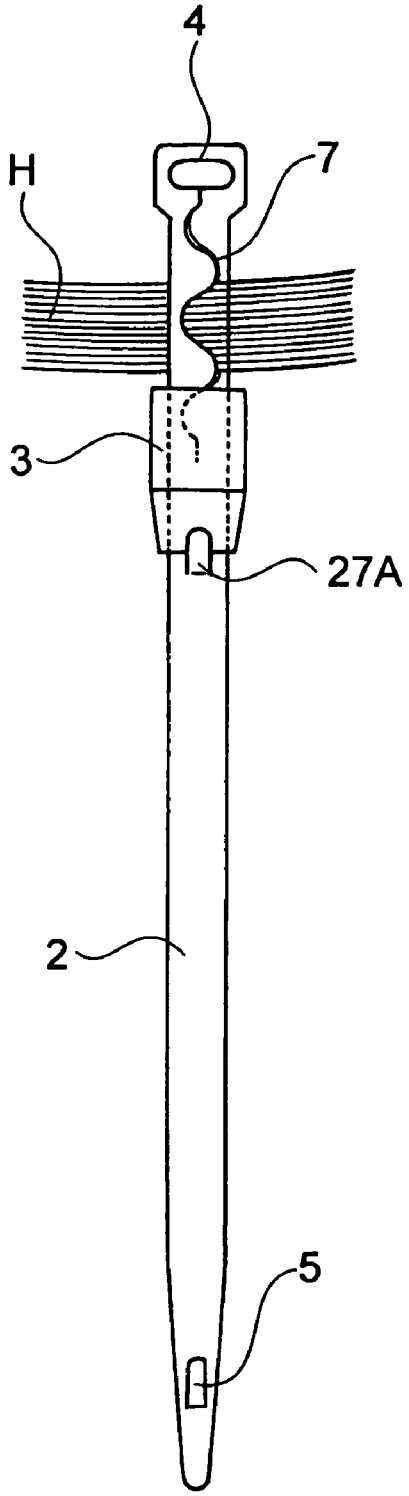
FIG. 9(*a*) and FIG. 9(*b*) depict usage of the hair inserter of the third embodiment, showing in sequence the way of catching a hair bundle.
Figure 9B:
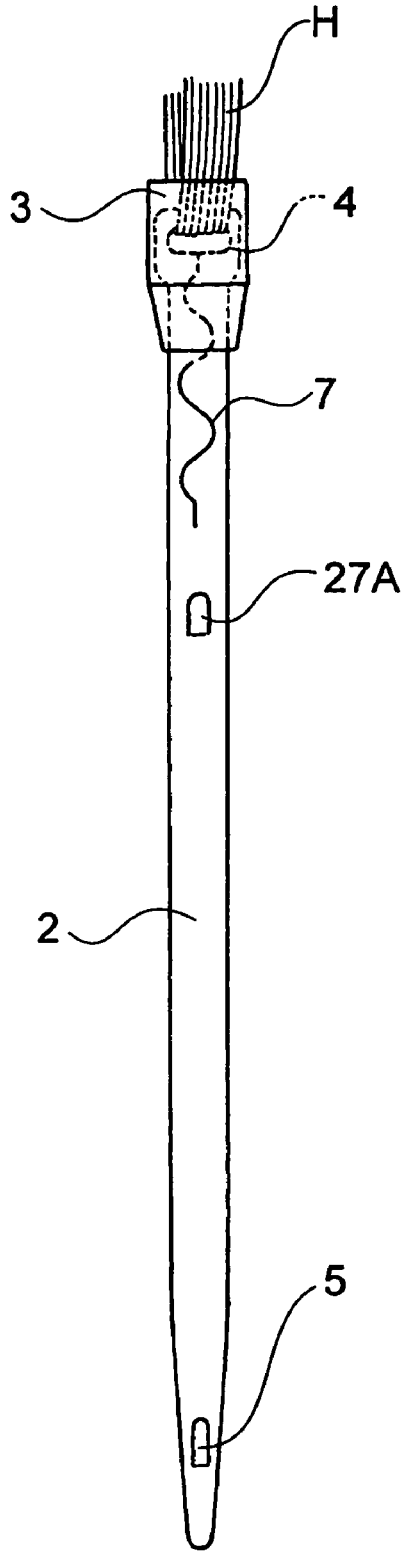

As shown in FIGS. 8(*a*) and 8(*b*), a sliding member 3 is provided in the vicinity of the hair catching part 7 slidably in the longitudinal direction of the hair inserter 1. The sliding member 3 is thicker and wider than the hair catching part 7. The sliding member 3 has an insertion hole (not shown) in its bottom, through which the hair catching part 7 is inserted. The sliding member 3 is slid to the top to cover the hole 4 of the hair catching part 7 as shown in FIG. 9(*b*).

When seen from the side, the sliding member 3 has its bottom (the end closer to the lower end of the plate-like member 2) sloped on the front and the rear side of the plate-like member 2 as shown in FIG. 8(*b*). Accordingly, the thickness of the sliding member 3 increases smoothly in the direction from the lower to the upper ends of the plate-like member 2. When viewed from the front, the sliding member 3 has its both sides sloped as depicted in FIG. 8(*a*). Accordingly, the width of the sliding member 3 increases gradually in the direction from the lower to the upper ends of the plate-like member 2.

An up-pointing lower stopper 27A is provided on the front side of the hair inserter 1 near the boarder between the main body and the hair catching part 7. The lower stopper 27A is formed by cutting a U shape near the upper end of the plate-like member 2 and pulling the U-shape toward the front. An upper stopper 27B extending outward in the width direction of the hair inserter 1 is provided near the upper end of, and on both longer sides of, the hair catching part 7. The sliding member 3 can move down until its lower end hits the lower stopper 27A as shown in FIG. 8 and move up until it is stopped by the upper stoppers 27B as shown in FIG. 9(*b*).

Use of the hair inserter 1 of the third embodiment starts from the state in which the sliding member 3 is located lowest as in FIGS. 8(*a*) and 8(*b*). The hair catching part 7 is slightly opened as in FIG. 9(*a*), a hair bundle H is passed through the hair catching part 7, and the sliding member 3 is slid upward. As a result, the hair bundle H is caught in the hole 4 of the hair catching part 7 and fixed between the hair catching part 7 and the sliding member 3.

The plate-like member 2 has an anti-return portion (tab) 5 near its lower end as shown in FIGS. 8(*a*) and 8(*b*). The anti-return tab 5 is formed of a part of the plate-like member 2 near the lower end. After the lower end of the plate-like member 2 emerges from the lower opening T2 of a hair holder, the anti-return tab 5 is designed to catch the edge of the lower opening T2 of the hair holder T thereby to stop a possible movement of the plate-like member 2 in the direction opposite to the direction of insertion. The anti-return tab 5 is formed by making a U shaped cut in the part of the plate-like member 2 near its lower end and pulling up the U-shape. The anti-return tab 5 catches the edge of the lower opening T2 of a hair holder thereby to prevent the hair holder T from sliding down along the hair inserter 1.

The hair inserter 1 of the third embodiment is operated in the same manner as for the one of the first embodiment shown in FIG. 1 to produce the same effects as in the first embodiment in inserting a hair bundle into a hair holder.

Figure 10:
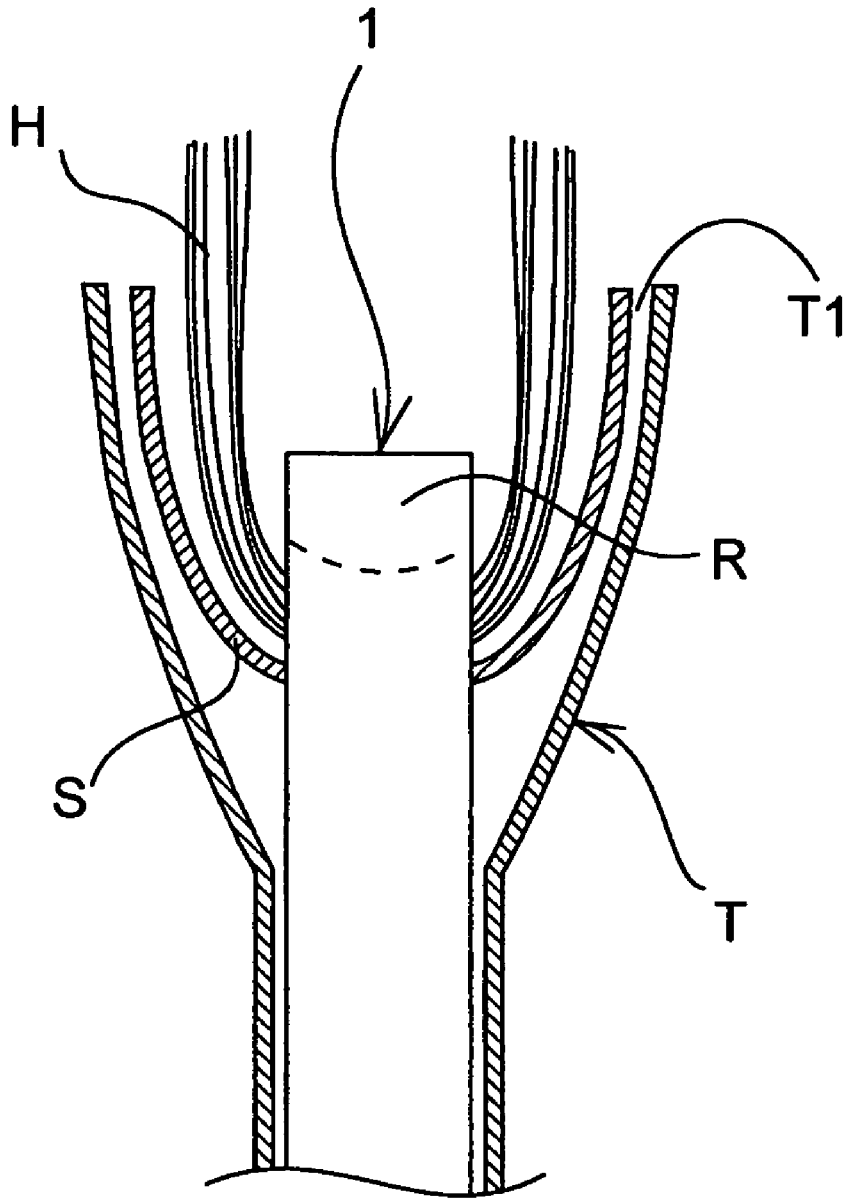
FIG. 10 is a cross-sectional view of a hair holder and a space-forming member, schematically illustrating the space-forming members creating a tubular space in the hair holder when a hair inserter of the present invention enters the hair holder.

The space-forming member or structure of the hair inserter according to the present invention is not limited to those used in the aforementioned embodiments as long as it is capable of forming a tubular space in a tubular hair holder T as illustrated in FIG. 10 so that the hair inserter 1 having a hair bundle H caught on its hair catching part R may be led through the tubular space and smoothly inserted from the upper opening T1 to the lower opening T2. The structure shown in FIG. 10, in which a space-forming member S is designed to be located near the bend of a hair bundle H, is especially preferred for facilitating the insertion of the hair with the tubular space near the bend of a hair bundle H. It is still preferred that the space-forming member S be designed to enclose a hair catching part R and a hair bundle H caught thereby for reducing the insertion resistance of the hair bundle H against a hair holder.

The sliding member does not always need to be greater than the hair catching part in both thickness and width. It is preferred that the sliding member have its thickness and/or width increased in the direction from the lower to upper ends of the main body. The sloping portion of the sliding member may have either only the width or both the width and thickness increased in the direction from the lower to upper ends of the main body.

The main body and the space-forming member of the hair inserter may be composed separately as in the first embodiment shown in FIG. 1 and the third embodiment shown in FIG. 8 or may be composed integrally. A plurality of space-forming members may be provided as in the second embodiment shown in FIG. 5. The main body preferably has its lower end rounded to improve its insertability.

The curling style of the tube of the hair holder that is used in combination with the hair inserter of the present invention is not limited to a roll shape as in the foregoing embodiments and includes, according to the purpose, an accordion-folded shape, a zig zag shape, and a spiral shape. The tube can be formed by any method. For example, a sheet material can be sewed, heat sealed or bonded with an adhesive, or a flat tube can be made by extrusion molding.

Figure 11A:
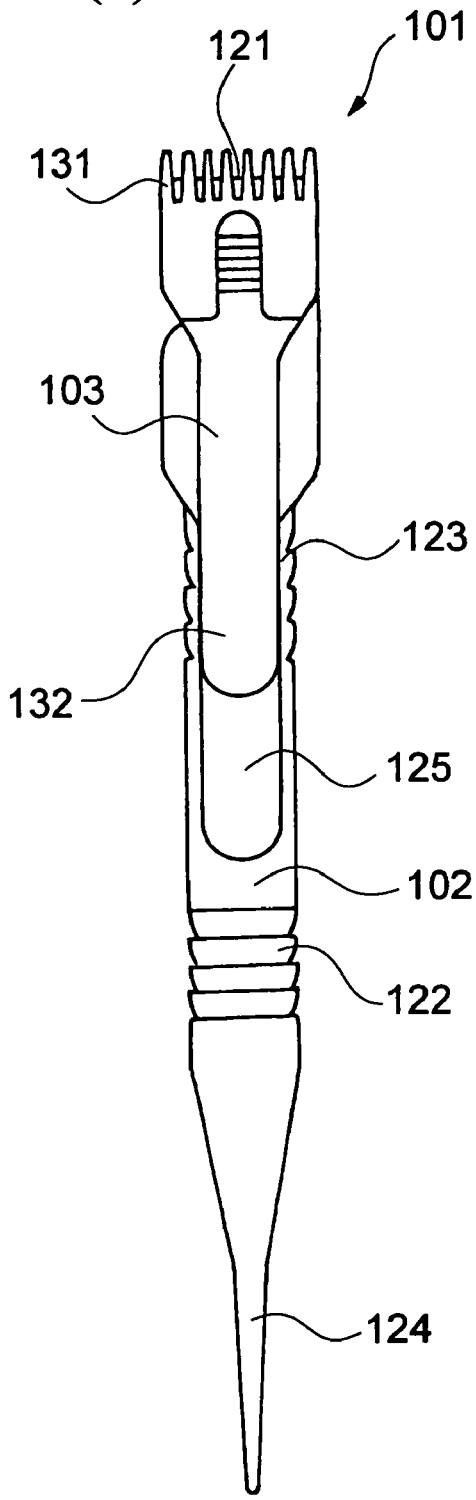
FIG. 11(*a*) and FIG. 11(*b*) are front views showing a fourth embodiment of the hair inserter according to the present invention, in which FIG. 11(*a*) shows a combing member positioned uppermost, and FIG. 11(*b*) has the combing member positioned lowermost.
Figure 11B:
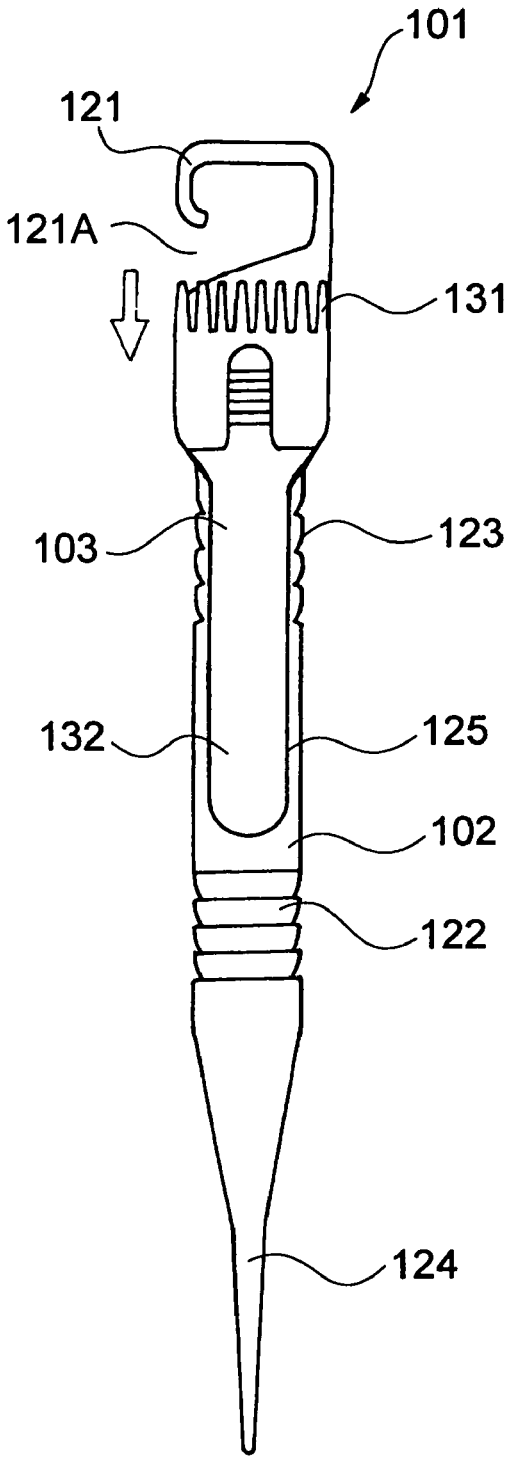
Figure 12A:
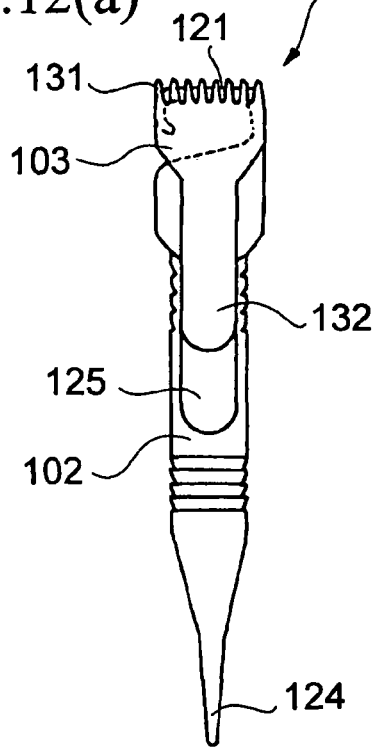
FIG. 12(*a*), FIG. 12(*b*), FIG. 12(*c*), and FIG. 12(*d*) depict the first half of usage of the hair inserter according to the fourth embodiment, illustrating in due order how to fix a hair bundle to the hook.
Figure 12B:
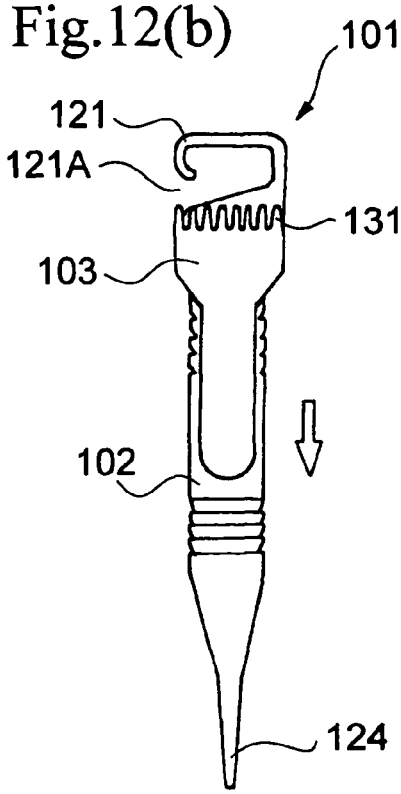
Figure 12C:
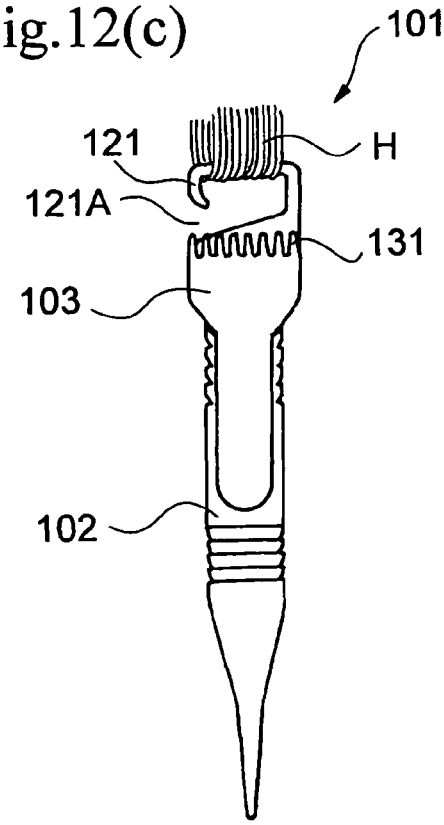
Figure 12D:
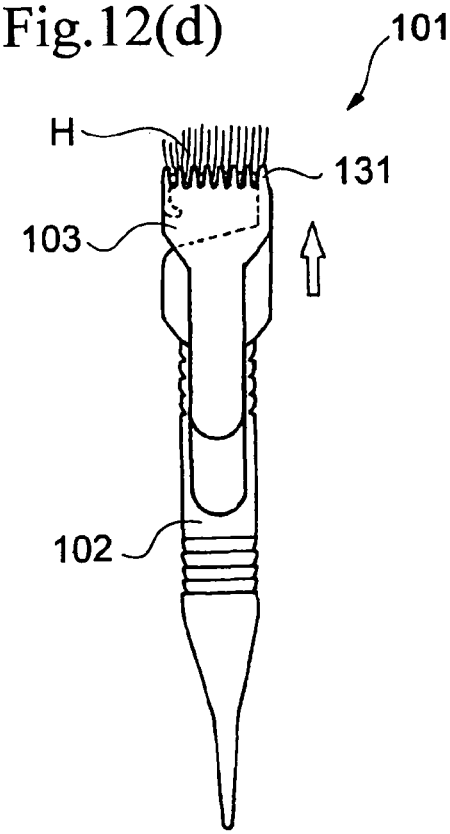
Figure 13A:
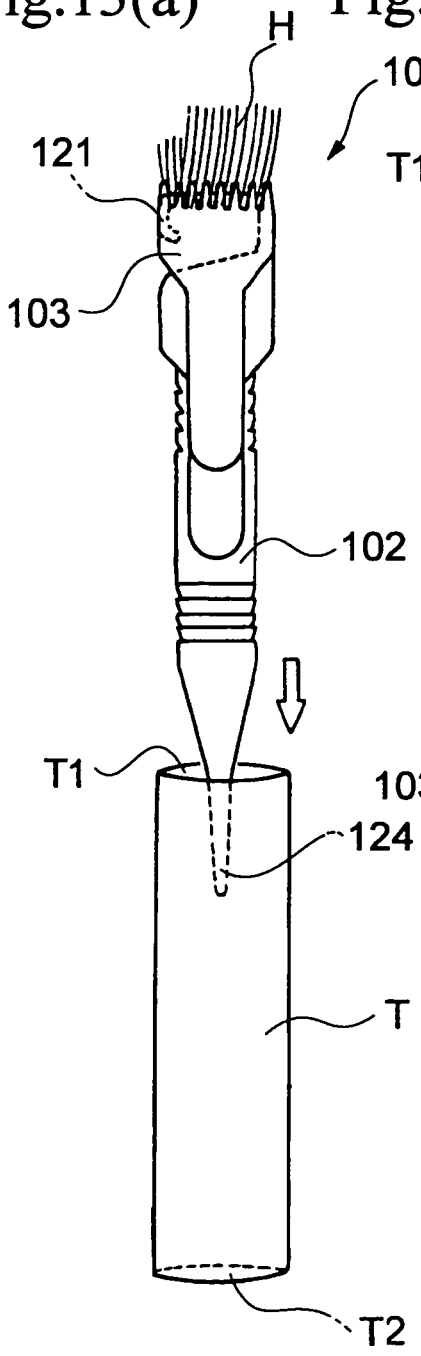
FIG. 13(*a*), FIG. 13(*b*), and FIG. 13(*c*) depict the second half of usage of the hair inserter according to the fourth embodiment, illustrating the steps for passing the hair inserter through a hair holder.
Figure 13B:
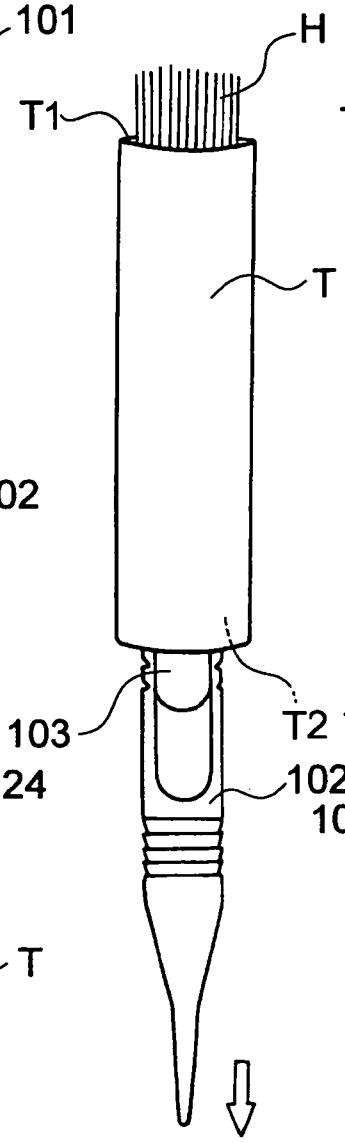
Figure 13C:
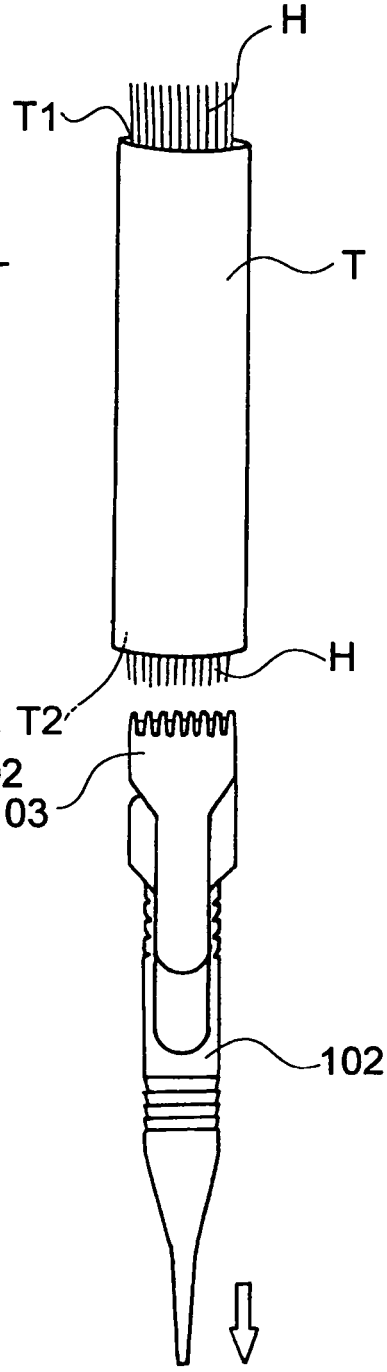

The fourth embodiment of the hair inserter according to the present invention will be described by way of FIGS. 11 through 13. As shown in FIGS. 11 to 13, the fourth embodiment provides a hair inserter 101 for inserting a hair bundle H into a hair holder T having a flat tube made of a sheet in such a design that the hair bundle H can be inserted therethrough from an opening T1 at one end thereof (an upper opening T1) toward another opening T2 at the other end thereof (a lower opening T2). The hair inserter 101 includes (1) a bar-like main body 102 having, at one end thereof, a hook 121 on which a hair bundle H can be caught and (2) a closing member

103 capable of covering the opening 121A of the hook 121. In this embodiment, the closing member 103 also serves as a space-forming member.

The hair inserter 101 of the fourth embodiment will be described in more detail. The main body 102 is almost a flat bar as shown in FIGS. 11(*a*) and 11(*b*). The main body 102 has a hook 121 at the upper end thereof. The lower end 124 of the main body 102 is tapered so that it may easily be put into a tubular hair holder T. The main body 102 has, in its lengthwise middle portion, a recess 125 for sliding which extends in the longitudinal direction.

An anti-return portion 122 is provided on both side edges in the width direction of the hook 121 of the main body 102. After the main body 102 having caught a hair bundle H enters a hair holder T, the anti-return portion 122 prevents the main body 102 from getting back in the reverse direction. The anti-return portion 122 is provided around the whole circumference of the main body 102 in an area between the lower end 124 of the main body 102 and the recess 125 for sliding. The circumference of the anti-return portion 122 increases toward the hook 121. The main body 102 also has a non-slip portion 123 formed on both long side edges thereof. The non-slip portion 123 on each edge is by the side of the recess 125 and nearer to the hook 121 than to the lower end 124. The non-slip portion 123 has its width increased toward the hook 121 and serves to prevent slip when held by hand.

The closing member 103 is a combing member having comb teeth 131 at the upper end thereof as shown in FIGS. 11(*a*) and 11(*b*). The combing member 103 is slidable in the length direction of the main body 102 with its comb teeth 131 pointing to the hook 121 so that a hair bundle H as caught on the hook 121 may be fixed between the hook 121 and the comb teeth 131. The sliding protrusion 132 inclusive of the lower end of the combing member 103 has its cross-section configured to engage with the recess 125 for sliding. The combing member 103 is provided on each side of the main body 102.

The combing member 103 is always urged against the hook 121 by a resilient member (not shown). The resilient member is a coil spring disposed in a space (not shown) formed in a place covered by the combing member 103 of the main body 102. The coil spring links the main body 102 and the combing member 103 to exert urging force against the combing member 103 toward the hook 121. The combing member 103 is capable of being slid downward until the sliding protrusion 132 comes into contact with the lower end of the recess 125 of the main body 102 and upward until the tips of the comb teeth 131 stick out of the hook 121.

The main body 102 and the combing member 103 can be made by machining or molding synthetic resin materials or machining metallic materials. The members used in this embodiment are made by machining a synthetic resin material.

Usage of the hair inserter according to the fourth embodiment is explained by referring to FIGS. 12 and 13. The hair inserter 101 before use has its combing member 103 positioned in the side of the hook 121 as in FIG. 12(*a*). The combing member 103 is slid toward the lower end 124 of the main body 102 against the urging force of the resilient member as shown in FIG. 12(*b*). The combing member 103 can move down until its sliding protrusion 132 meets the lower end of the recess 125 of the main body 102. Whereupon the hook 121 that has been hidden by the combing member 103 appears. Since the combing member 103 is always urged against the hook 121, a force that overcomes the urged force above must continuously be applied to the combing member 103 to keep the exposure of the hook 121.

A hair bundle H that is to be inserted into a hair holder T is then caught on the hook 121 as shown in FIG. 12(*c*). On releasing the applied force above from the combing member 103, it slides to the hook 121 by the urging force thereby fixedly sandwiching the hair bundle H, caught on the hook 121, from both sides of the main body 102.

As shown in FIGS. 13(*a*), 13(*b*), and 13(*c*), the hair inserter 1 thus having the hair bundle H fixed is put into the upper opening T1 of a hair holder T with its lower end 124 first and drawn out from the lower opening T2. Immediately before the hook 121 of the hair inserter 101 comes out of the lower opening T2 of the hair holder T, it is advisable to slightly slide the combing member 103 down to the lower end 124 of the main body 102 for releasing the hair bundle H from being fixed.

After the hair inserter 101 is passed through the hair holder T from the upper opening T1 to the lower opening T2, the hair bundle H is held in the hair holder T with its tip slightly sticking out of the lower opening T2 as shown in FIG. 13(*c*). Thereafter the hair bundle H can be given a desired curl by, for example, rolling up the hair holder T.

By use of the hair inserter 101 according to the fourth embodiment, a hair bundle H can easily be inserted into a hair holder T by the above-described procedures. Since the hair bundle H caught on the hook 121 is fixed between the hook 121 and the comb teeth 131, the hair bundle H hardly slips out of the hook 121 during the insertion of the hair bundle H into the hair holder T. While the hair bundle H is being led into and through a hair holder T, even if a reaction force is applied to the main body 102 in the direction opposite to the direction of insertion, the anti-return portion 122 of the main body 102 contacts the inner surface of the hair holder T and reduces the reaction force so that the hair inserter 101 is easily and smoothly drawn out of the hair holder T. Where a hair bundle is caught in a closed loop, the hair bundle must be passed from one hand to the other after the bundle is passed through the loop, which tends to make the bundle disordered and impair operationality of the hair holder. According to the fourth embodiment, because the hair bundle H is caught by the hook 121, a user does not have to pass the hair bundle H from one hand to the other. Therefore, the hair bundle is not disordered, and the user can easily operate the hair holder.

The fifth embodiment of the hair inserter according to the present invention and its modifications will be described with reference to FIGS. 14 through 16. These hair inserters are used to insert a hair bundle into a hair holder T having the above-described structure. The hair inserter 101 of the fifth embodiment shown in FIGS. 14(*a*), 14(*b*), and 14(*c*) has a substantially bar-like main body 104 having a hook 141, which is capable of catching a hair bundle H, at the upper end thereof and a closing member 105 that closes the inlet (or throat opening) 141A of the hook 141.

Figure 14A:
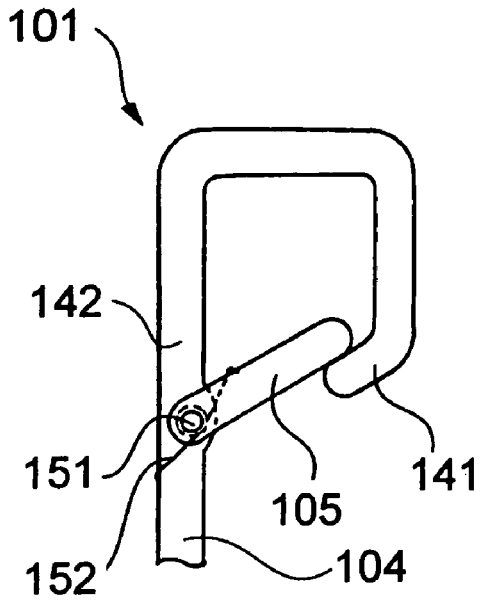
FIG. 14(*a*), FIG. 14(*b*), and FIG. 14(*c*) are front views of one end of a hair inserter according to a fifth embodiment of the present invention, in which FIG. 14(*a*) shows the one before a hair bundle is caught on the hook, and FIGS. 14(*b*) and 14(*c*) illustrate in sequence the way of hooking a hair bundle.
Figure 14B:
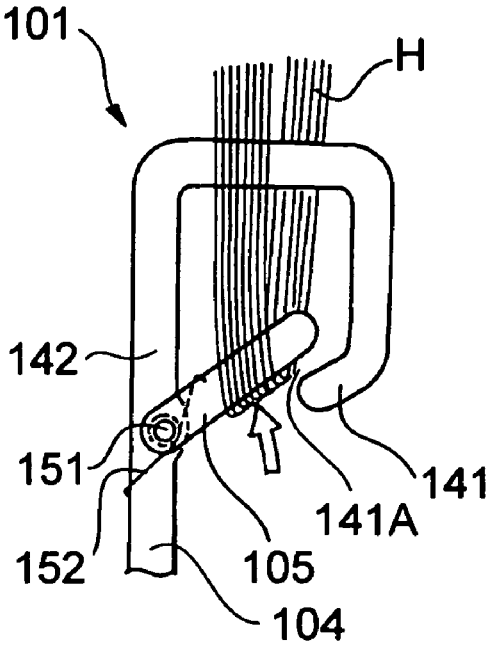
Figure 14C:
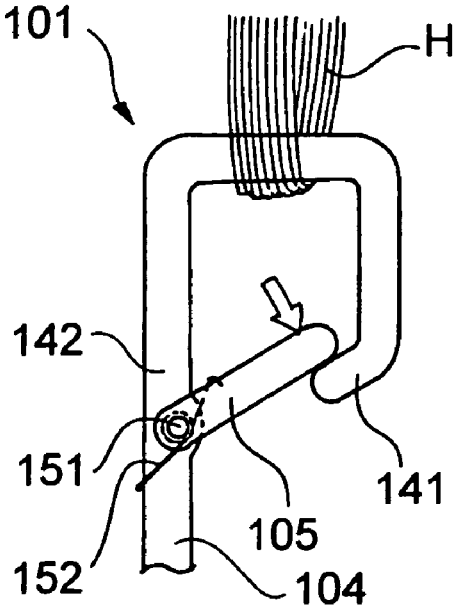

The hair inserter 101 of the fifth embodiment is described further by referring to FIGS. 14(*a*), 14(*b*), and 14(*c*). The closing member 105 is a safety latch that swings on a pivot axis 151 provided on the shank 142 of the hook 141 and it connects the shank 142 and the tip (claw) of the hook 141. A torsion spring 152 formed by a coiled wire is supplied to the shank 142. One end of the torsion spring is fixed to the latch 105, the middle portion is coiled around the pivot axis 151, and the other end is hooked to the shank of the hook 141. The safety latch 105 is always urged toward the outside of the inlet 141A of the hook 141 as indicated by the arrow in FIG. 14(*c*).

Thus, when the safety latch 105 is pressed by an outer force, the outer force makes the inlet 141A open, and when the safety latch 105 is released from the outer force, the inlet 141A is closed by the repulsive resilient force. The other part of the hair inserter 101 from the lower end (the end to be inserted first into a hair holder) to the middle part can have various shapes, such as a round bar and a rectangular bar.

According to the hair inserter 101 having the hook 141 and the safety latch 105, the inlet 141A of the hook 141 is closed as depicted in FIG. 14(*a*) before use. On pressing (applying an outer force to) the latch 105 inward, the inlet 141A of the hook 141 is opened, and a hair bundle H can be caught on the hook 141 as shown in FIGS. 14(*b*) and 14(*c*). Simultaneously, the safety latch 105 is released from the outer force and returns to its original position by the repulsive resilient force of the torsion spring 152 to come into contact with the tip of the hook 141 and thereby to close the inlet 141A. In this way, the hair inserter 101 of the fifth embodiment has the following advantage. Once a hair bundle H is caught on the hook 141, a hair holder T can be operated with no need to shift the hair bundle H from one hand to the other. As a result, the hair bundle H is not disordered, and the hair holder T can easily be operated.

Figure 15A:
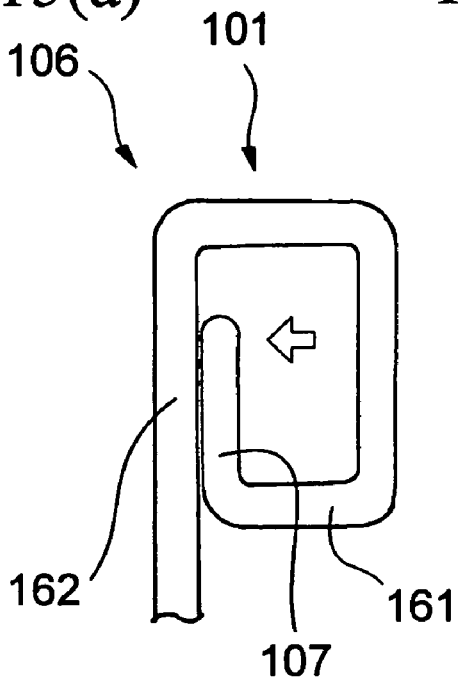
FIG. 15(*a*), FIG. 15(*b*), and FIG. 15(*c*) are front views of one end of a hair inserter according to a modification of the fifth embodiment, in which FIG. 15(*a*) shows the one before a hair bundle is caught on the hook, and FIGS. 15(*b*) and 15(*c*) illustrate in sequence how to hook a hair bundle.
Figure 15B:
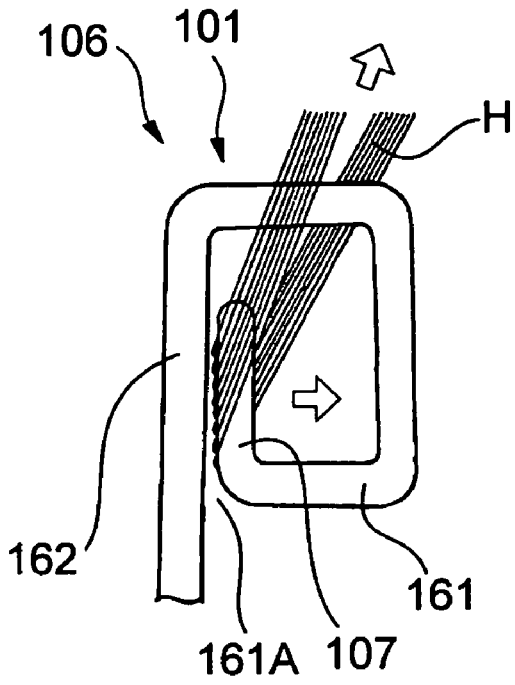
Figure 15C:
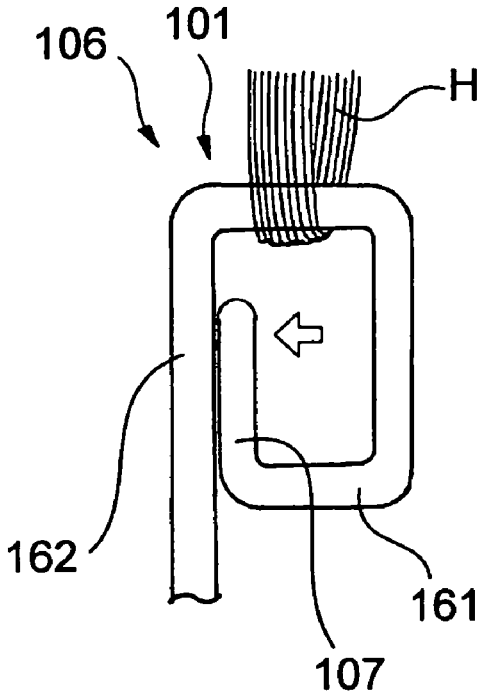
Figure 16A:
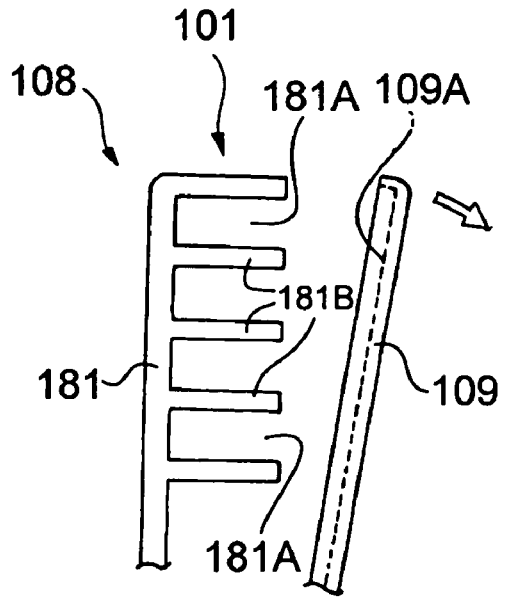
FIG. 16(*a*), FIG. 16(*b*), FIG. 16(*c*), and FIG. 16(*d*) are front views of one end of a hair inserter according to another modification of the fifth embodiment, in which FIGS. 16(*a*) and 16(*c*) each show the one before a hair bundle is caught on the hook, and FIGS. 16(*b*) and 16(*d*) illustrate the way of hooking a hair bundle on the hair catching part.
Figure 16B:
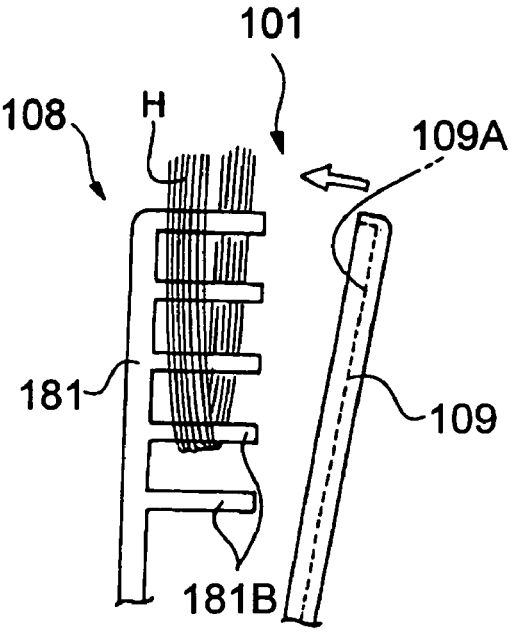
Figure 16C:
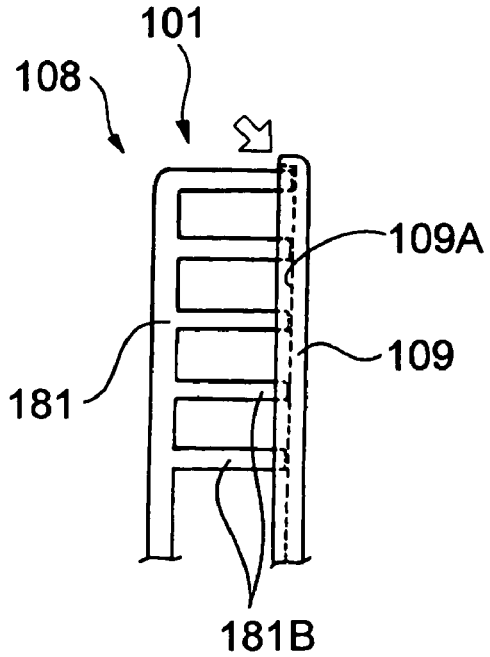
Figure 16D:
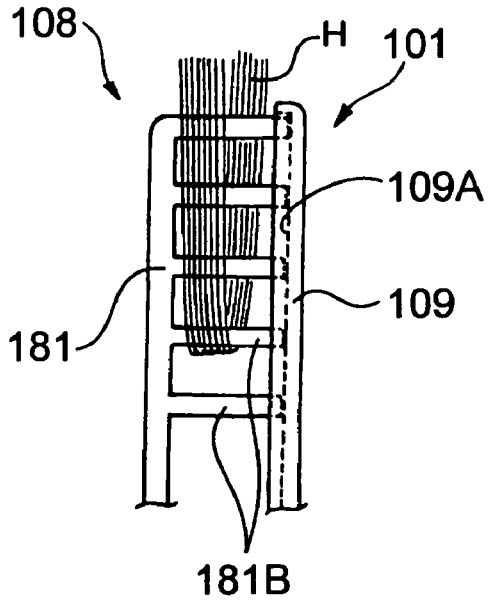

A modification of the hook with closing member (safety latch) according to the fifth embodiment is shown in FIGS. 15(*a*), 15(*b*), and 15(*c*). In this modification, the hair inserter 101 has a closing portion 107 that is integrated with a hook 161. As shown in FIG. 15(*a*), the hook 161 and the closing portion 107 make more than one turn (more than 360 degrees), and the closing portion 107 resiliently contacts with the shank 162 of the hook 161. In other words, the hook 161 and the closing portion 107 integrally shape a coil.

According to the hair holder described above, a hair bundle H is slipped into the opening 161A when a gap between the shank 162 of the hook 161 and the closing portion 107 is widened as shown in FIG. 15(*b*). Once the hair bundle H is slipped in and caught on the hook 161 as shown in FIG. 15(*c*), the closing portion 107 is released from the outer force and moves to the shank 162 of the hook 161 by its own resilient repulsive force to close the opening 161A. The hair inserter 101 according to the modification shown in FIG. 15 produces the same effects as by the one according to the fifth embodiment.

Another modification of the hook with closing member of the fifth embodiment is shown in FIGS. 16(*a*), 16(*b*), and 16(*c*). As shown in FIG. 16(*a*), the hair inserter 101 according to this modification has a comb-toothed hook 181 (looking like a comb in its front view) and a closing member 109 that covers the tips of the hook 181. The hook 181 and the closing member 109 are pivotally joined at a supporting point (not shown) in their base (not shown) and urged to each other by a spring (not shown). On being pressed at the base, the closing member 109 pivots in the direction indicated by the arrow of FIG. 16(*a*) by the principle of leverage thereby to open the hook 181.

The hook 181 has five comb teeth 181B extending in the width direction of the hair inserter 101 and equally spaced in the length direction of the hair inserter 101. The closing member 109 has a groove 109A extending in the length direction on the plane facing the tips of the comb teeth 181B and is adapted to enclose the teeth tips in this groove. That is, the closing member 109 is designed to close the openings 181A between the teeth 181B.

By the use of the hair inserter 101 having the thus designed hook 181 and the closing member 109, a hair bundle H can be caught on the hook 181 in accordance with the sequence of FIGS. 16(*a*), 16(*b*), and 16(*d*). To begin with, the base of the closing member 109 is pressed (application of outer force) to pivot the closing member 109 in the direction indicated by the arrow of FIG. 16(*a*). As a result, the groove 109A of the closing member 109 separates from the tips of the comb teeth 181B of the hook 181 whereby the openings 181A of the hook 181 is exposed. In this state, a hair bundle H is invited between the row of tips of the comb teeth 181B and the groove 109A and caught on at least one of the comb teeth 181B as shown in FIG. 16(*b*). On removing the outer force applied to the cover 109, the closing member 109 moves in the direction indicated by the arrow of FIG. 16(*b*) by the repulsive resilient force of the spring. As a result, the tips of the comb teeth 181B of the hook 181 are fitted into the groove 109A of the closing member 109 as shown in FIG. 16(*d*) to close the openings 181A.

A hair bundle H may be caught on the hook 181 of the hair inserter 101 shown in FIG. 16(*a*) by operating in the sequence from FIGS. 16(*c*) to 16(*d*). In this case, a hair bundle (not shown) is pressed to the closing member 109 in the direction indicated by the arrow of FIG. 16(*c*) to make a gap between the row of tips of the comb teeth 181B of the hook 181 and the groove 109A of the closing member 109. The hair bundle is slid through the gap and caught on the hook 181, whereupon the closing member 109 returns to its original position to close the openings 181 of the hook 181A.

By the above-described operation, a hair bundle H can also be caught on the hook 181 as in FIG. 16(*d*). In the modified embodiment shown in FIG. 16, a hair bundle H can be caught on any of the five comb teeth 181B. It is also possible that a hair bundle is parted into smaller bundles and the smaller bundles are caught on different comb teeth 181B.

The form of the hair catching part of the main body is not limited to the hook as in the foregoing embodiments. The hair catching part may be a hook whose tip always contact with other part of the hook or may be a loop that is in lack of the intermediate comb teeth 181B.

Figure 17A:
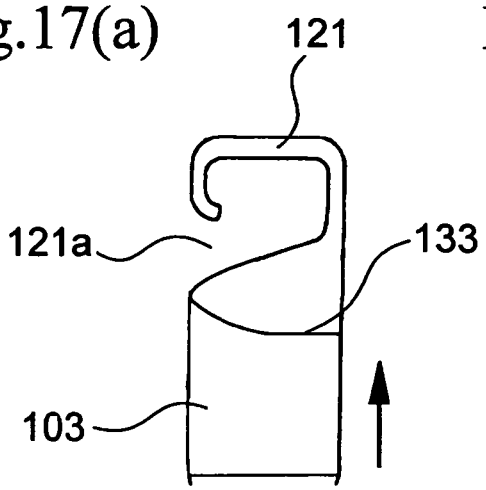
FIG. 17(*a*) and FIG. 17(*b*) are front views of one end of a hair inserter according to a modification of the fourth embodiment, in which FIG. 17(*a*) shows a hook with its opening uncovered, and FIG. 17(*b*) shows the hook with its opening covered.
Figure 17B:
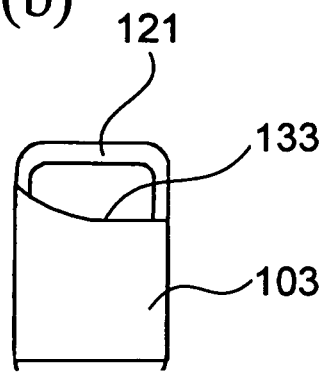
Figure 18A:
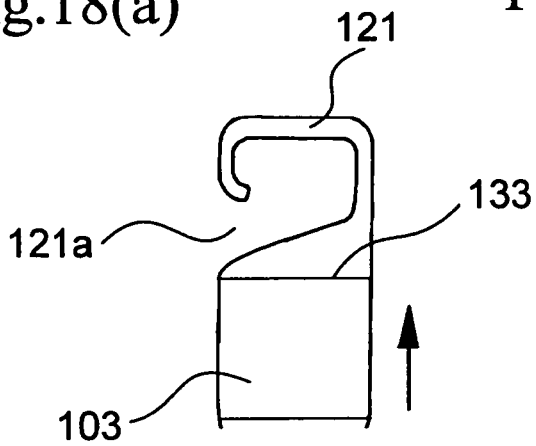
FIG. 18(*a*) and FIG. 18(*b*) are front views of one end of a hair inserter according to another modification of the fourth embodiment, in which FIG. 18(*a*) shows a hook with its opening uncovered, and FIG. 18(*b*) shows the hook with its opening covered.
Figure 18B:
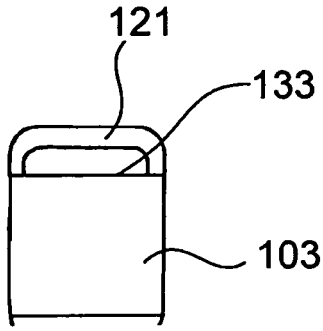
Figure 19A:
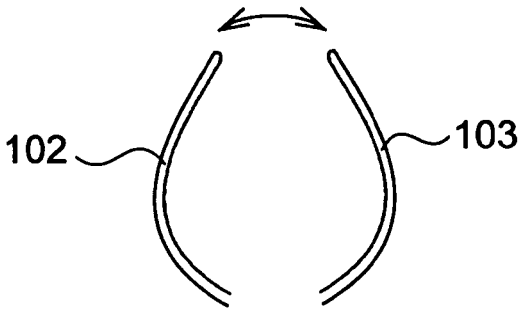
FIG. 19(*a*) and FIG. 19(*b*) are front views of one end of a hair inserter according to still another modification of the fourth embodiment, in which FIG. 19(*a*) shows a hook in its opened state, and FIG. 19(*b*) shows the hook in its closed state.
Figure 19B:
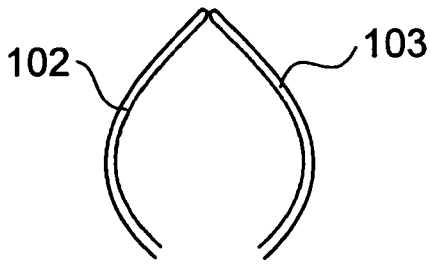

The hair inserter having a closing member slidable in the longitudinal direction of the main body as in the fourth embodiment shown in FIG. 11 includes modifications shown in FIGS. 17 through 19. That is, the upper edge 133 (the edge closer to the hook 121) of the closing member 103 may form the shape "J" laying on its side as in FIGS. 17(*a*) and 17(*b*), or may be straight in parallel with the width direction of the main body as in FIGS. 18(*a*) and 18(*b*). Or, the hook 121 and the closing member 103 may constitute a pair of stag beetle's horns as shown in FIGS. 19(*a*) and 19(*b*).

Figure 20A:
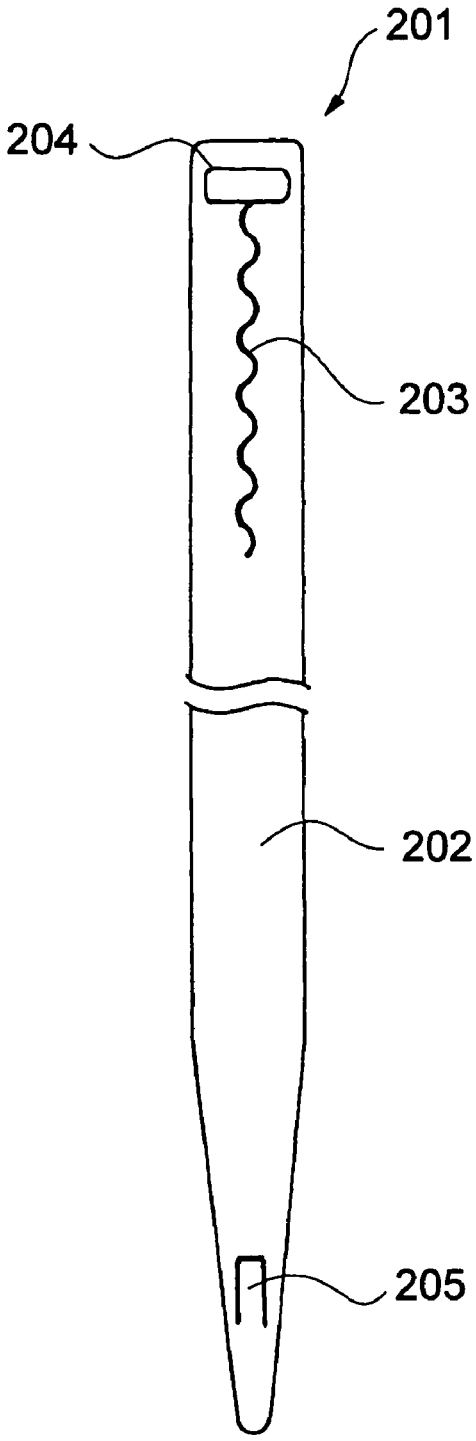
FIG. 20(*a*) and FIG. 20(*b*) are front views of a sixth embodiment of the hair inserter according to the present invention, in which FIG. 20(*a*) shows the one before use, and FIG. 20(*b*) the one with a hair bundle caught in its hair catching part.
Figure 20B:
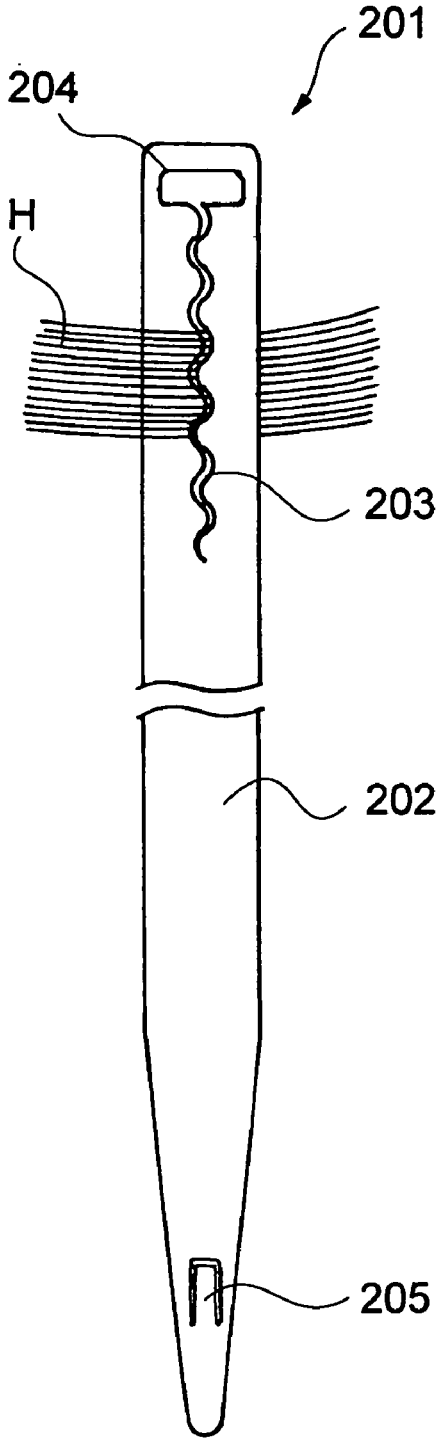
Figure 21A:
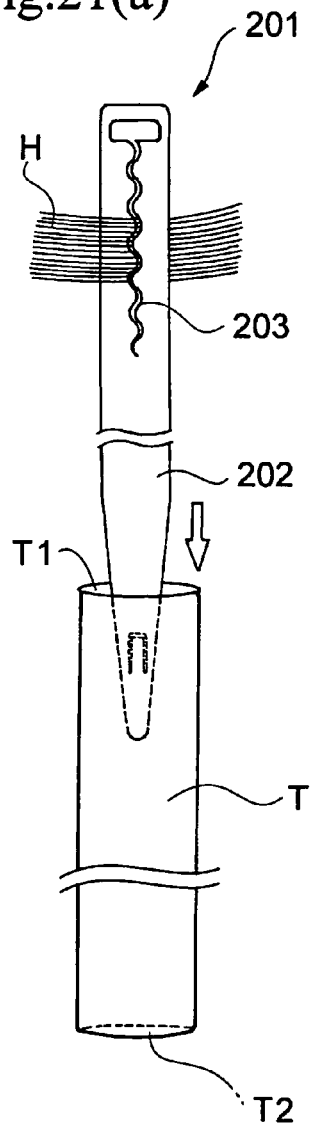
FIG. 21(*a*), FIG. 21(*b*), and FIG. 21(*c*) are front views illustrating usage of the hair inserter according to the sixth embodiment, showing the steps for passing the hair inserter through a hair holder.
Figure 21B:
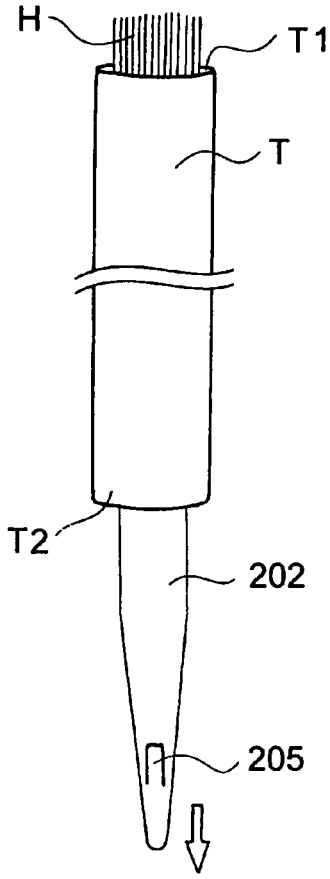
Figure 21C:
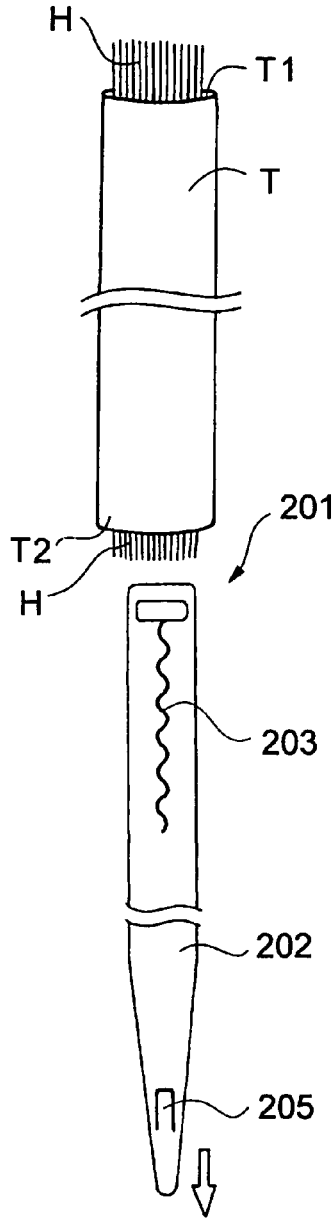
Figure 22:
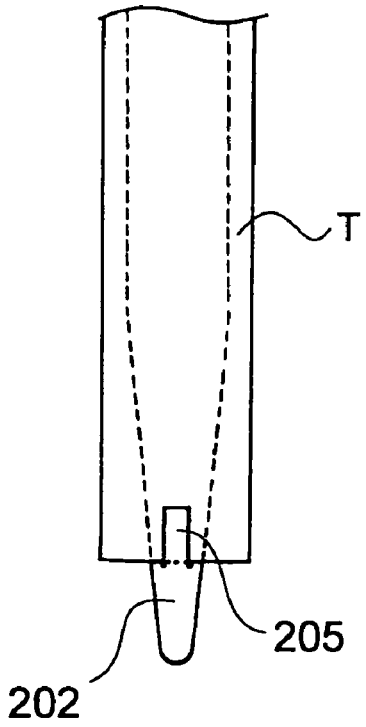
FIG. 22 is a partial front view of the hair inserter according to the sixth embodiment, in which an anti-return tab of a plate-like member catches the edge of the lower opening of the hair holder.

The sixth embodiment of the hair inserter according to the present invention is described by referring to FIGS. 20 to 22. As shown in these figures, the sixth embodiment provides a hair inserter 201 for inserting a hair bundle H into a hair holder T having a flat tube made of a sheet in such a design that the hair bundle H can be inserted therein from an upper opening T1 toward a lower opening T2. The hair inserter 201 has a hair catching part 203 in the upper end portion thereof. The hair inserter also has an anti-return portion (tab) 205 that prevents the hair inserter from returning in the direction opposite to the direction of insertion into a hair holder T after it catches a hair bundle H and enters the hair holder T.

The hair inserter 201 of the sixth embodiment is described further. As illustrated in FIG. 20(*a*), the hair inserter 201 of the present embodiment is a long and narrow plate-like member 202 with its lower end tapered. The plate-like member 202 is made of a rigid synthetic resin sheet, a metal plate, etc. The plate-like member 202 in this embodiment is made of rigid synthetic resin sheet.

The hair catching part 203 is a waving slit extending in the longitudinal direction of the plate-like member 202 as shown in FIG. 20(*a*), in which a hair bundle H is to be passed and fixed. An almost rectangular hole 204 is formed by cutting out the upper end portion of the plate-like member 202, and the upper end of the hair catching part 203 is linked to the hole 204.

As shown in FIG. 20(*a*), the anti-return tab 205 is formed of a part of the plate-like member 202 (i.e., the hair inserter 201). After the lower end of the plate-like member 202 emerges from the lower opening T2 of a hair holder T, the plate-like member 202 is prevented from getting back in the reverse direction because the anti-return tab 205 is engaged with the edge of the lower end opening T2 of the hair holder T. The anti-return tab 205 is formed by cutting a U shape near the lower end of the plate-like member 202 and pulling the U-shape to the front. The maximum circumference of the hair inserter 201 can be decided appropriately in consideration of the strength and handling easiness, provided that it is within the inner circumference of a cross-section of the hair holder T.

Usage of the hair inserter according to the sixth embodiment is explained by way of FIGS. 20 and 21. The waving slit of the hair catching part 203 is slightly opened, and a hair bundle H is passed through the hair catching part 203 and fixed there as shown in FIG. 20(*b*).

The hair inserter 201 with the hair bundle H fixed therethrough is inserted into the hair holder T from the upper opening T1 with its lower end first and then drawn from the lower opening T2 of the hair holder T as illustrated in FIGS. 21(*a*), 21(*b*), and 21(*c*).

After the hair inserter 201 is passed through the hair holder T from the upper opening T1 to the lower opening T2, the hair bundle H is held in the hair holder T with its tip slightly sticking out of the lower opening T2 as shown in FIG. 21(*c*). Thereafter the hair can be curled in a desired style by, for example, rolling up the hair holder T.

A hair bundle H can smoothly be inserted into a hair holder T with the hair inserter 201 of the sixth embodiment in accordance with the above-described procedures. Before a hair bundle H is inserted into the hair holder, the hair bundle H and the hair catching part 203 of the hair inserter 201 should be held by the respective hands. Therefore, the hair holder T is liable to slide down. The hair inserter 201 according to the sixth embodiment has the anti-return tab 205 near the lower end of the plate-like member 202. The anti-return tab 205 catches the edge of the lower opening T2 of the hair holder T as shown in FIG. 22 thereby preventing the hair holder T from falling off the hair inserter 201. Hence, the hair inserter 201 and the hair holder T are in unity and co-operative to improve the operationality particularly when operated by one person.

Furthermore, since a hair bundle H is fixedly held in the waving slit of the hair catching part 203, the hair bundle H hardly slips through the slit while being inserted into the hair holder T, and the hair holder T successfully holds the intended part of the hair bundle H. Thus, the operationality is improved. To enhance the effect in preventing a hair holder T from holding an undesirable part of a hair bundle, it is preferred to use the hair inserter 201 according to this embodiment in combination with a hair holder T whose upper opening T1 has high stiffness.

Still other embodiments of the hair inserter according to the present invention will be described only with reference to differences from the sixth embodiment shown in FIG. 20. To those particulars that are not described here, the description given to the sixth embodiment applies. The hair inserters according to the embodiments described below are capable of smoothly inserting a hair bundle into a hair holder similarly to the one described above.

Figure 23A:
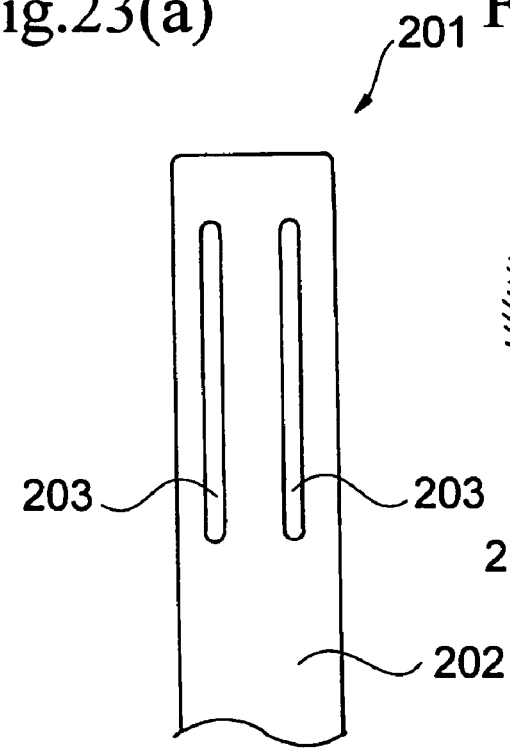
FIG. 23(*a*) and FIG. 23(*b*) show the vicinity of a hair catching part of a hair inserter according to a seventh embodiment of the present invention, in which FIG. 23(*a*) shows the one before use, and FIG. 23(*b*) the one with a hair bundle caught therein.
Figure 23B:
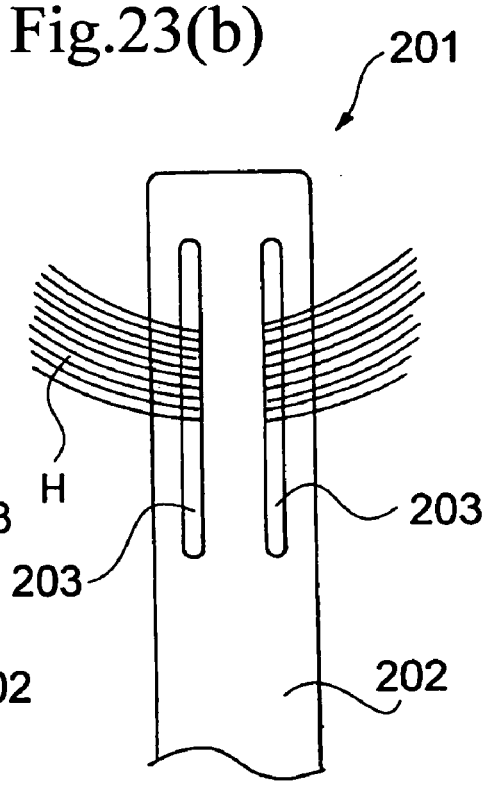

As shown in FIG. 23(*a*), the hair catching part 203 of a hair inserter 201 according to a seventh embodiment of the invention is a plurality of (two, in FIG. 23(*a*)) straight slits formed extending in parallel to the longitudinal direction of the plate-like member 202. The hair inserter 201 has the same composition as the hair inserter of the sixth embodiment other than the hair catching part. As shown in FIG. 23(*b*), a hair bundle H is fixedly caught in the hair catching part 203 by passing the hair through one of the two slits and then the other. The hair inserter 201 of the seventh embodiment having a hair bundle H fixed therethrough in this way can be used in the same manner as for the one of the sixth embodiment shown in FIG. 20 to produce the same effects as in the sixth embodiment and is capable of successfully inserting a hair bundle H into a hair holder T.

Figure 24A:
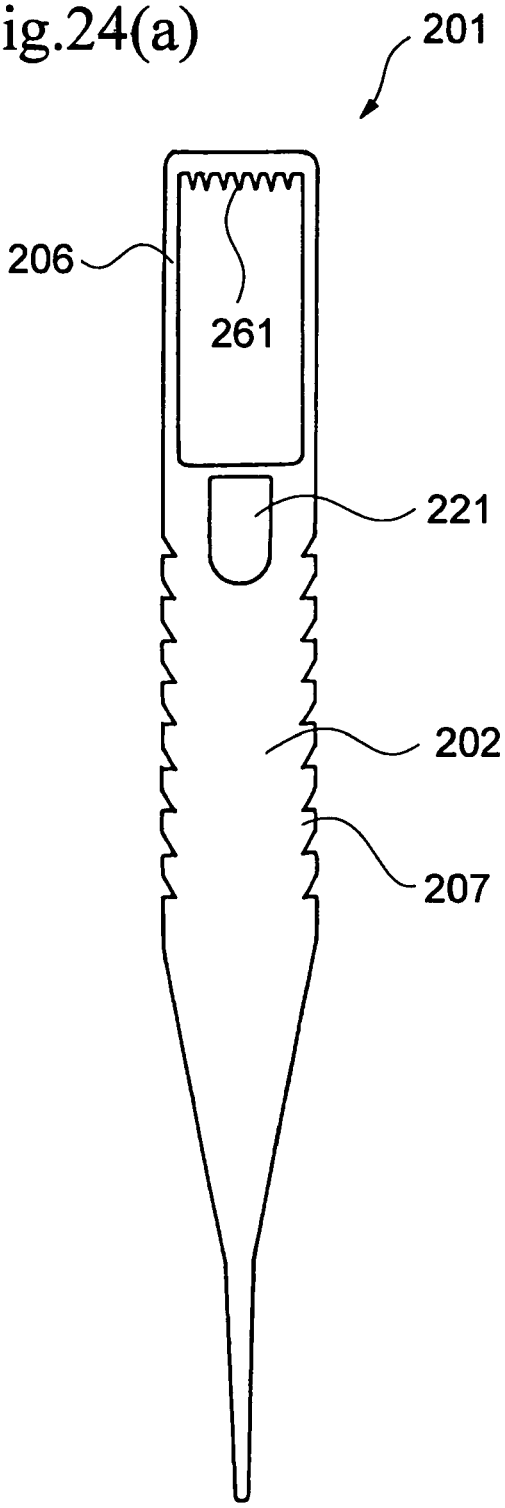
FIG. 24(*a*) and FIG. 24(*b*) are front views of an eighth embodiment of the hair inserter according to the present invention, in which FIG. 24(*a*) illustrates the state before use, and FIG. 24(*b*) the state with a hair bundle caught on the hair catching part.
Figure 24B:
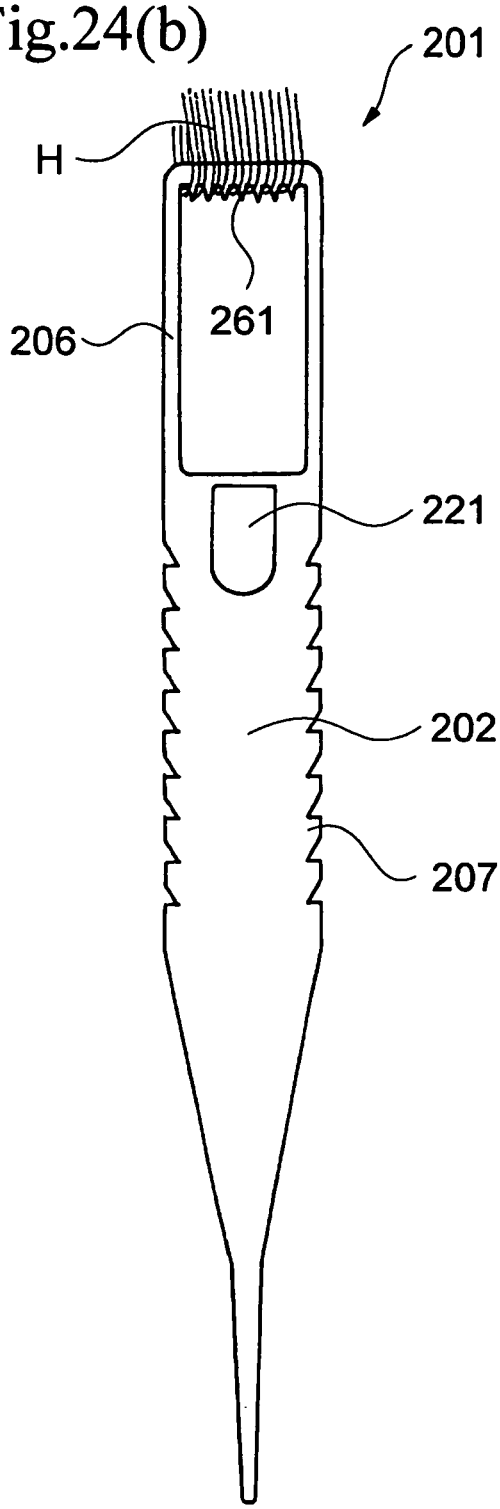

As shown in FIGS. 24(*a*) and 24(*b*), a hair inserter according to an eight embodiment of the invention is a plate-like member 202 having a hair catching part 206 capable of catching a hair bundle H at the upper end portion thereof, anti-return portions 207, and downward comb teeth 261 on the inner side of the hair catching part 206. The anti-return portion 207 is a range of protrusions 207 provided on each long side edge of the plate-like member 202 and prevents the plate-like member 202 having a hair bundle H caught thereon from getting back in the direction opposite to the direction of insertion after entering a hair holder T.

The hair inserter 101 of the eighth embodiment is described in more detail. The plate-like member 202 is a long and narrow plate as shown in FIG. 24(*a*), the width of which is slightly smaller than the inner width of a hair holder T. The plate-like member 202 has a thick portion 221 thicker than the other part of the plate-like member 202 in the lengthwise middle area on both faces thereof. The hair catching part 206, which is frame-shaped, is formed at the upper end portion of the plate-like member 202. The frame has comb teeth 261 on its inner circumferential face of one of the sides in the width direction of the plate-like member 202. The plate-like member 202 has protrusions 207 formed on both long side edges, which width increased toward the hair catching part 203.

By using the thus constructed hair inserter 201, a hair bundle H can be passed through the hair catching part 206 and caught on the comb teeth 261 as illustrated in FIG. 24(*b*). The hair inserter 201 with the hair bundle H caught therein is passed through a tubular hair holder (not shown) thereby to insert the hair bundle H inside the hair holder with ease. When the hair bundle H enters the hair holder, even if a reaction force is exerted to the plate-like member 202 in the reverse direction, the plate-like member 202 hardly gets back because the projections 207 catches on the inner surface of the hair holder.

The hair inserter according to the present invention preferably has 0.7 to 1.0 times as long a maximum outer circumference as the inner circumference of a cross-section of a hair holder. With the maximum outer circumference of the hair inserter being 0.7 times the inner circumference of a cross-section of a hair holder, the hair holder can be tucked up. This operation (tucking up) results in increase of contact area and friction between the hair inserter and the hair holder, thereby preventing the hair holder from sliding down from the hair inserter, and further the hair holder whose length is extremely longer than that of the hair inserter can be used because of the tucking up. On the other hand, when the maximum outer circumference of the hair inserter is 1.0 times the inner circumference of a cross-section of a hair holder, any hair inserter is usable as far as the hair holder can be stretched and does not tear when the hair inserter is inserted into the hair holder. The term "maximum outer circumference" used for the hair inserter is defined to be the outer circumference of a position at which a hair holder substantially stops.

The hair inserter of the present invention is not limited to those having a plate-like member as in the aforementioned embodiments and may be one having a member with a circular cross-section, a member with a triangular cross-section or a member with a polygonal cross-section including a rectangular cross-section. The hair catching part 203 of the plate-like member 202 may have the design shown in FIGS. 25(*a*) and 25(*b*), in which a straight slit extends downward from the upper end of the plate-like member 202, and a catching member 208 formed of wire is attached to the upper end of the plate-like member 202.

Figure 25A:
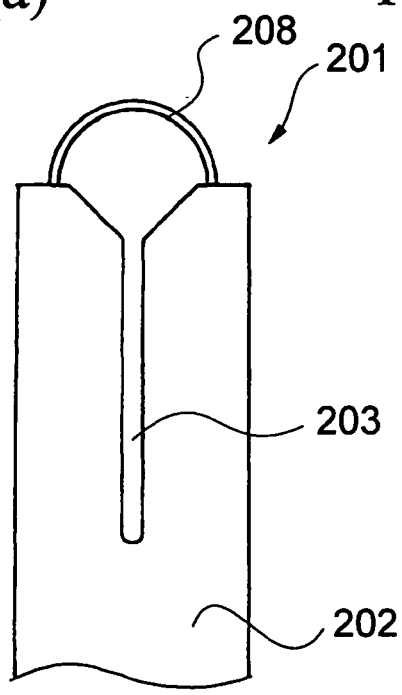
FIG. 25(*a*) and FIG. 25(*b*) are partial front views of the vicinity of a hair catching part of a hair inserter according to a modification of the seventh embodiment, in which FIG. 25(*a*) illustrates the state before use, and FIG. 25(*b*) the state with a hair bundle caught on the hair catching part.
Figure 25B:
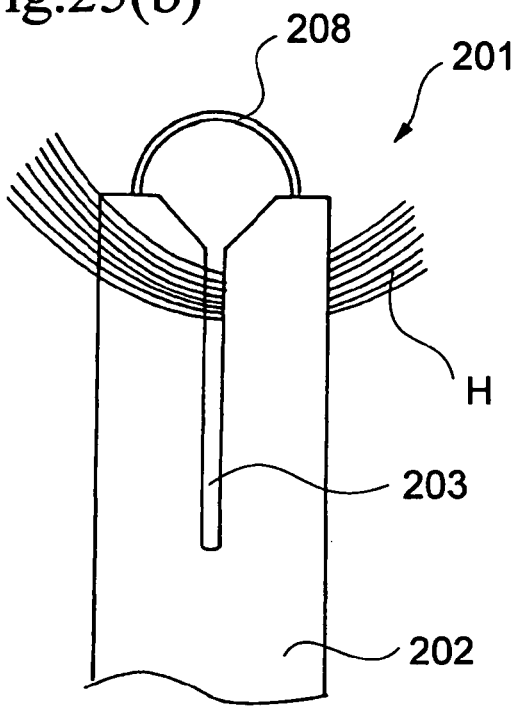
Figure 26:
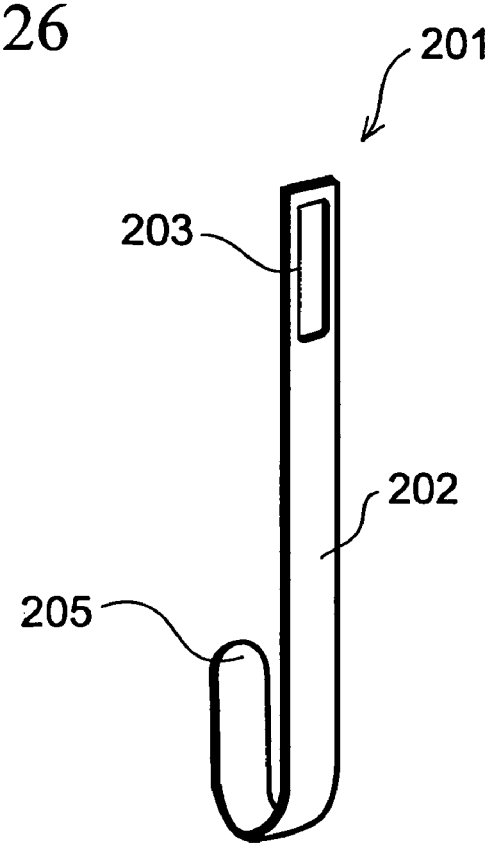
FIG. 26 is a perspective view of a hair inserter according to another modification of the seventh embodiment.
Figure 27:
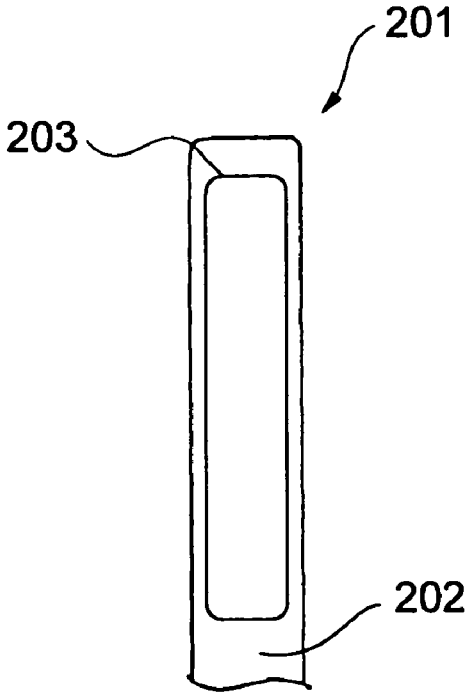
FIG. 27 is a front view of the vicinity of a hair catching part of a hair inserter according to another modification of the seventh embodiment.

According to the embodiment shown in FIGS. 25(*a*) and 25(*b*), a hair bundle H is passed through the slit of the hair catching part 203 and fixed there. The hair inserter 201 with the hair bundle H caught therein can be used in the same manner as in the seventh embodiment shown in FIG. 23(*a*). The catching member 208 catches the hair bundle H and secures the hair bundle H against coming off from the hair inserter 201 in case where the hair slides off the slit of the hair catching part 203 while the hair inserter 201 is being inserted into a hair holder. The anti-return tab 205 may be formed by bending the lower end of the plate-like member 202 as shown in FIG. 26. The hair catching part 203 may be a hole having an almost rectangular shape as shown in FIG. 27.

Figure 28A:
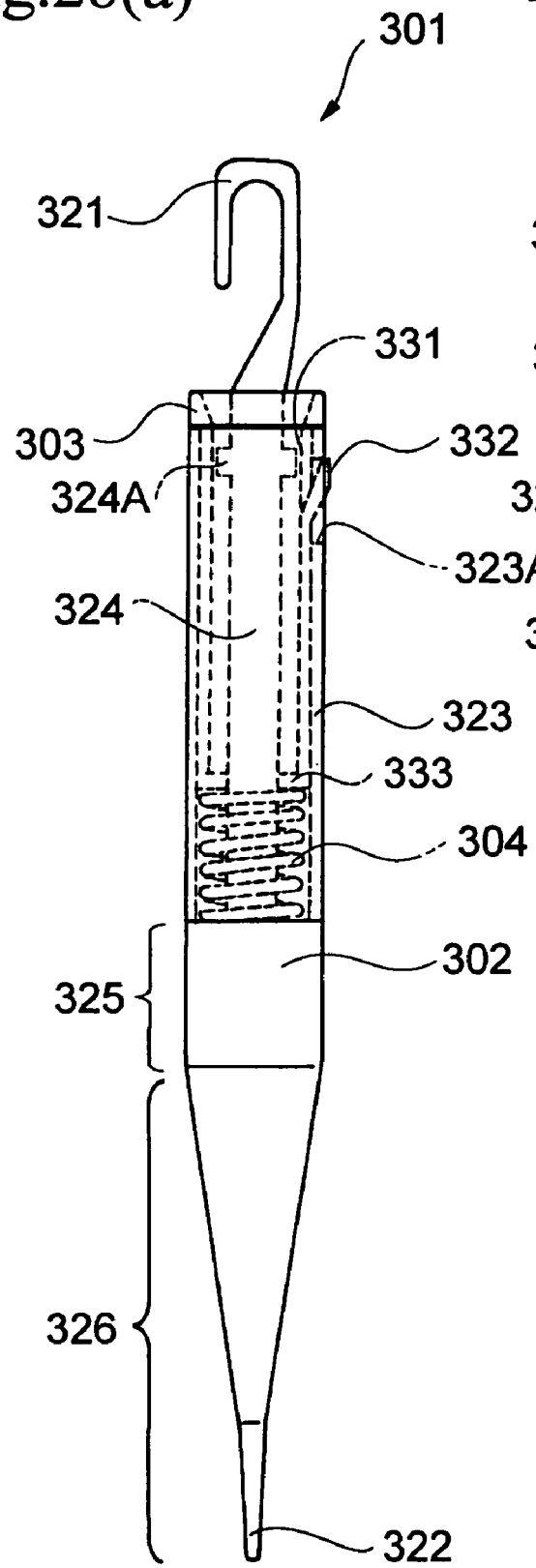
FIG. 28(*a*) and FIG. 28(*b*) are front views of a ninth embodiment of the hair inserter according to the present invention, in which FIG. 28(*a*) shows the state with the hook uncovered, and FIG. 28(*b*) the state with the hook enclosed in a sliding member.
Figure 28B:
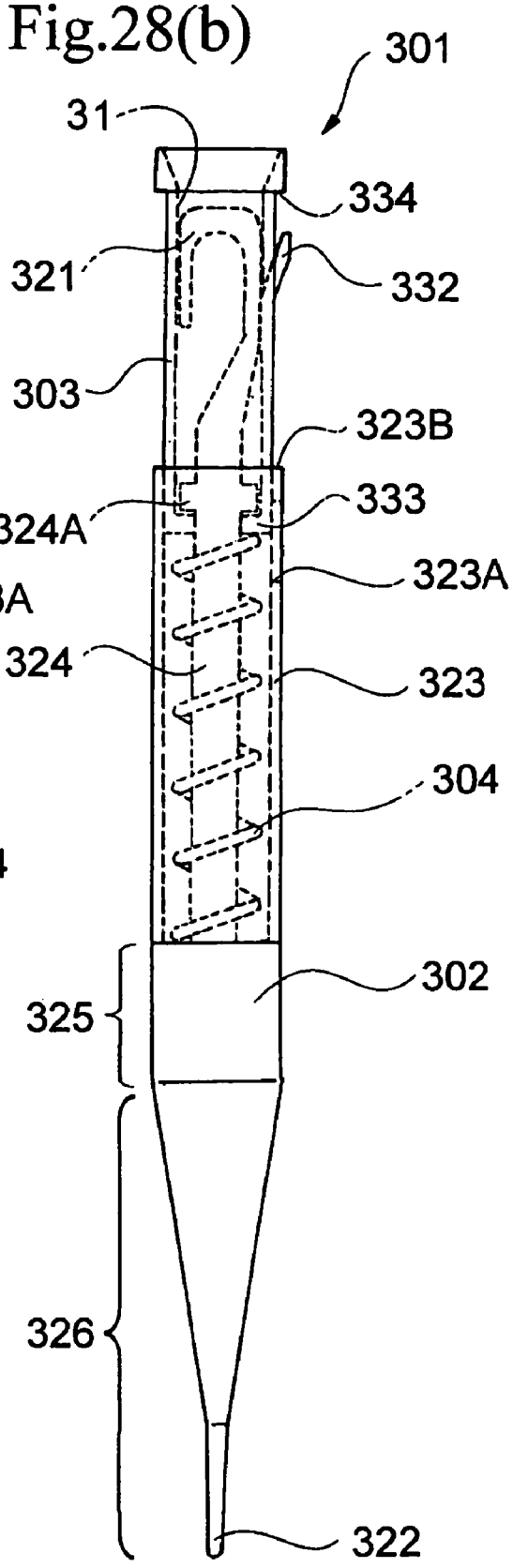
Figure 29A:
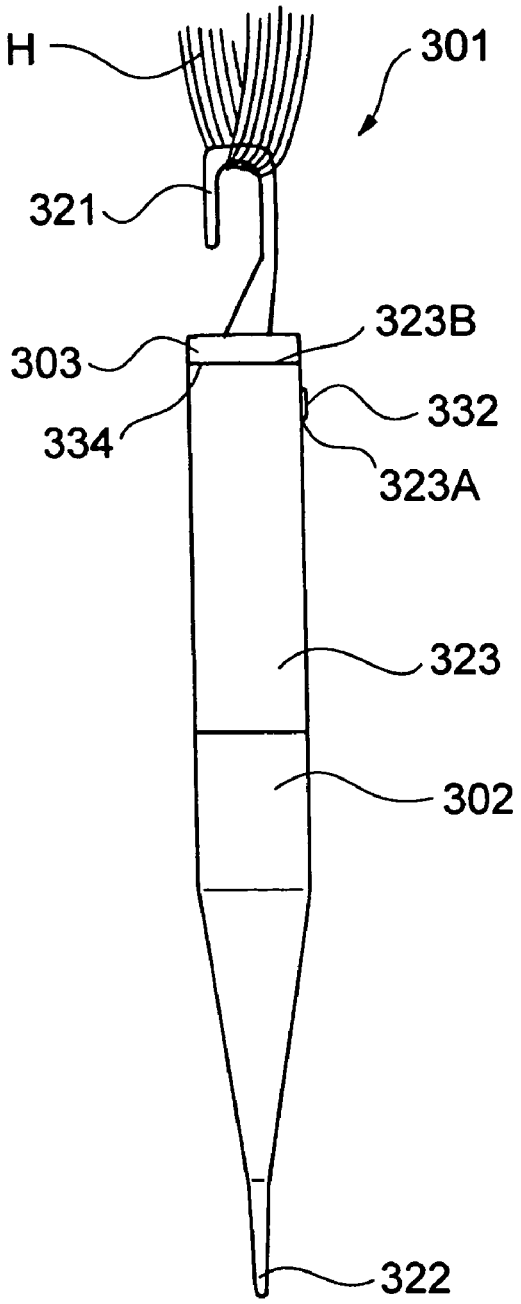
FIG. 29(*a*) and FIG. 29(*b*) are front views of the hair inserter according to the ninth embodiment, illustrating the first half of usage, i.e., the way of fixing a hair bundle to the hook.
Figure 29B:
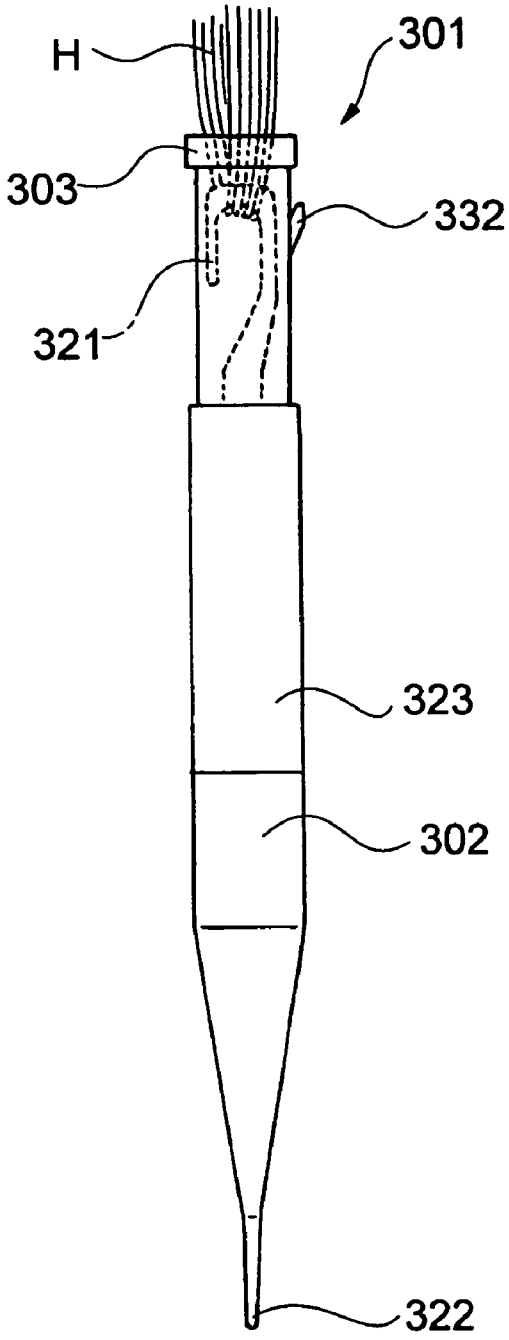
Figure 30A:
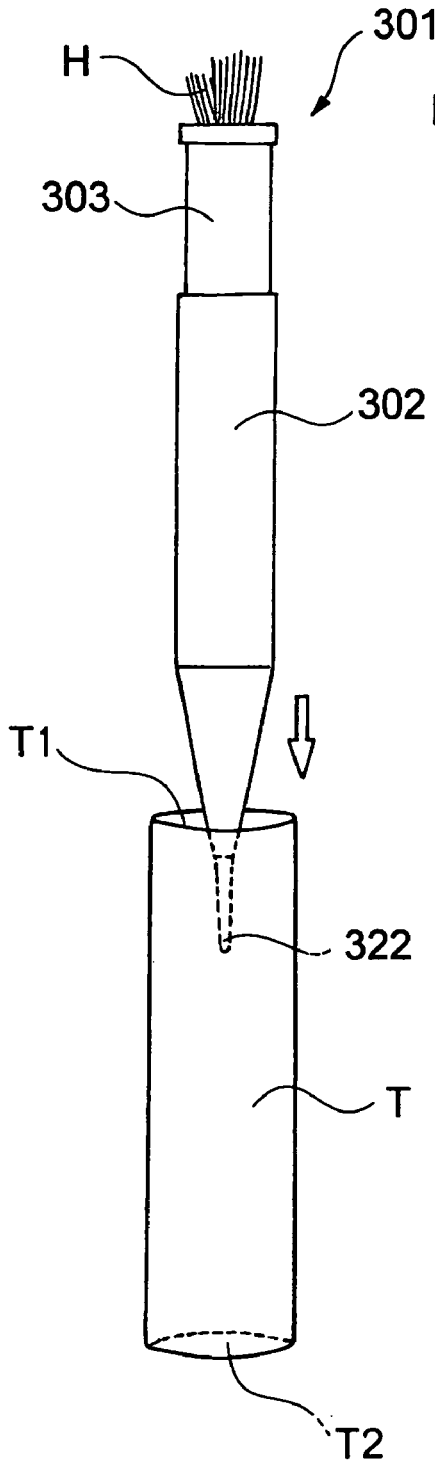
FIG. 30(*a*), FIG. 30(*b*), and FIG. 30(*c*) are front views of the hair inserter according to the ninth embodiment, illustrating in sequence the second half of usage, i.e., the way of passing the hair inserter through a hair holder.
Figure 30B:
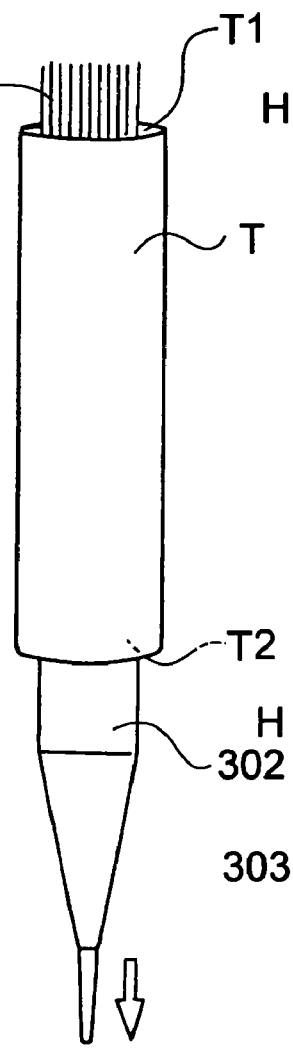
Figure 30C:
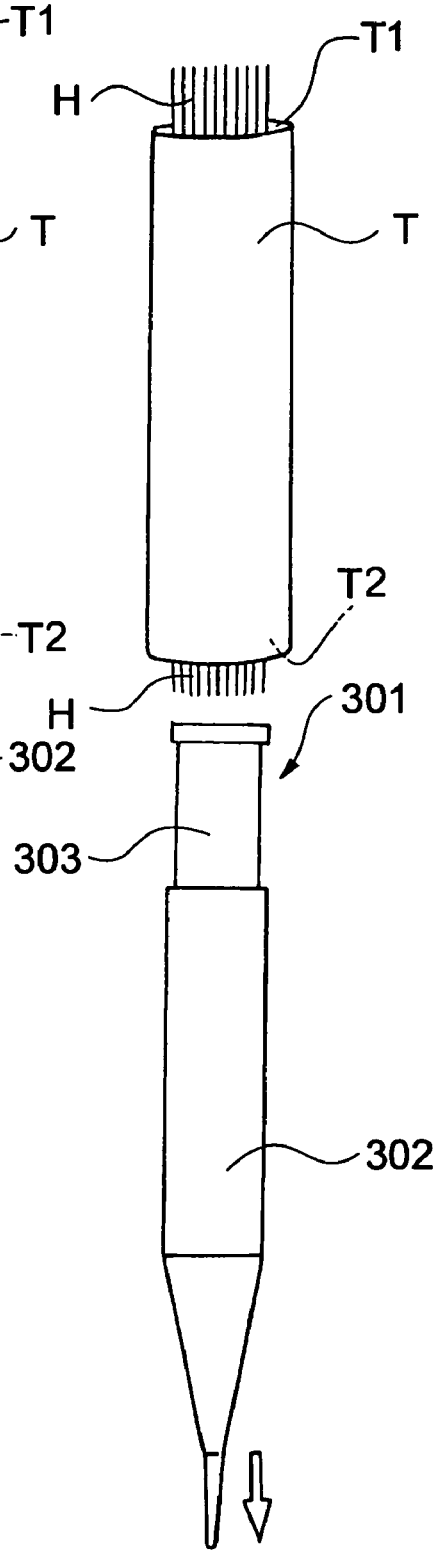

A ninth embodiment of the hair inserter according to the present invention is described by referring to FIGS. 28 through 30. As shown in FIGS. 28 to 30, the hair inserter 301 of the ninth embodiment is a tool for inserting a hair bundle H into a hair holder T having a flat tube made of a sheet in such a design that a hair bundle H can be inserted therethrough from an upper opening T1 thereof toward a lower opening T2 thereof. The hair inserter 301 consists of (1) a substantially bar-like main body 302 having, at one end portion thereof, a hair catching part 321 by which a hair bundle H can be caught and (2) a sliding member 303 that is slidable in the longitudinal direction of the main body 302 and capable of enclosing the hair catching part 321 in its upper portion so that the hair bundle H caught on the hair catching part 321 may be fixed between the hair catching part 321 and the sliding member 303. In the ninth embodiment, the sliding member 3 serves as a space-forming member.

The hair inserter 301 of the ninth embodiment will be described in greater detail. As shown in FIGS. 28(*a*) and 28(*b*), the main body 302 has a hollow cylindrical portion 323 between the hair catching part 321 and the lower end 322, in which portion the cylindrical sliding member 303 is inserted. The part of the main body 302 between the cylindrical portion 323 and the lower end 322 is sectioned into a columnar portion 325 nearer to the cylindrical portion 323 and having the same outer diameter as the cylindrical portion 323 and a lower portion 326 that is nearer to the lower end 322 and is tapered toward the lower end 322.

The hair catching part 321 has the shape of a hook as illustrated in FIG. 28(*a*). The cylindrical portion 323 has a hole 323A piercing through its wall near the hair caching part (hook) 321. In the hole 323A a projection 332 (hereinafter described) provided on the sliding member 303 is adapted to be engaged. The hook 321 and the columnar portion 325 are connected via a connecting portion 324 that extends through the hollow of the sliding member 303. The connecting portion 324 has a radially extending stopper 324A near the hook 321.

The sliding member 303 is a hollow cylinder in which the main body can be inserted. The sliding member 303 has a radially extending stopper 334 at the upper end thereof and has a bottom 333 at the lower end thereof. The bottom 333 has a hole through which the connecting portion 324 is inserted as shown in FIG. 28(*a*). The sliding member 303 has, on its outer periphery, a projection 332 that projects resiliently in the radial direction and is configured to be fitted into the hole 323A bored in the cylindrical portion 323 of the main body 302.

The sliding member 303 is inserted into the cylindrical portion 323 and is always urged to the hook 321 by a resilient member 304. More specifically, a resilient member 304 that is a coil spring is disposed helically around the connecting portion 324 with its upper end in contact with the bottom of the sliding member 303 and its lower end in contact with the end of the columnar portion 325 of the main body 302 as shown in FIGS. 28(*a*) and 28(*b*).

The sliding member 303 is movable toward the lower end 322 until its stopper 334 meets the upper end 323B of the cylindrical portion 323 of the main body 302 as illustrated in FIG. 28(*a*). It is movable toward the hook 321 until the inner side of the bottom 333 of the sliding member 303 comes into contact with the stopper 324A of the connecting portion 324 of the main body 302 as illustrated in FIG. 28(*b*). Thus, the hair inserter 301 of the ninth embodiment is capable of fixing a hair bundle H between the hook 321 and the inner peripheral surface of the upper end portion of the sliding member 303.

The main body 302 and the sliding member 303 can be made by, for example, machining or molding synthetic resin materials. In the ninth embodiment the cylindrical portion 323 and the other portion of the main body 302 are separate members. The outer diameter of both the columnar portion 325 and the cylindrical portion 323 of the main body 302 are preferably decided in the following manner that a moderate insertion resistance is generated when the hair inserter 301 is inserted into a tubular hair holder. Specifically, the maximum outer circumference of the hair inserter 301 is 0.7 to 1.0 times, preferably 0.8 to 1.0 times, as long as the inner circumference of a cross-section of the hair holder T. To make it sure that the hair inserter 301 does not get back while being inserted, a projection projecting in a radial direction may be provided on the outer peripheral surface of the columnar portion 325 and the cylindrical portion 323 of the main body 302.

Usage of the hair inserter according to the ninth embodiment is explained by way of FIGS. 29 and 30. On use, the sliding member 303 which is positioned near the hook 321 is slid toward the lower end 322 of the main body 302 against the urging force of the resilient member 304 as shown in FIG. 29(*a*). The sliding member 303 moves until its stopper 334 meets the end 323B of the cylindrical portion 323 of the main body 302, and the hook 321 which has been hidden by the sliding member 303 appears. On sliding the sliding member 303 to the end, the projection 332 of the sliding member 303 fits into the hole 323A of the cylindrical portion 323 of the main body 302 to maintain the sliding member 303 in that position. In this state a hair bundle H that is to be inserted into a hair holder T is caught on the hook 321.

The projection 332 of the sliding member 303 is pressed inward to disengage the sliding member 303 from the cylindrical portion 323 of the main body 302. Whereupon the sliding member 303 slides to the hook 321 as urged by the repulsion of the resilient member 304, i.e., the coil spring set inside the cylindrical portion 323 of the main body 302 as shown in FIG. 29(*b*). As shown in FIGS. 28(*b*) and 29(*b*), the sliding member 303 moves up until its bottom 333 hits against the stopper 324A of the connecting part 324 of the main body 302. In this way the hook 321 is enclosed inside the sliding member 303, and the hair bundle H caught on the hook 321 is fixed between the hook 321 and the inner peripheral surface 331 of the upper end portion of the sliding member 303.

The hair inserter 301 of the ninth embodiment having the hair bundle H fixedly held therein is inserted with its lower end 322 first into the upper opening T1 of a hair holder T and drawn from the lower opening T2 as illustrated in FIGS. 30(*a*), 30(*b*), and 30(*c*). After the hair inserter 301 is passed through the hair holder T from the upper opening T1 to the lower opening T2, the hair bundle H is held in the hair holder T with its tip slightly sticking out of the lower opening T2 of the hair holder T as depicted in FIG. 30(*c*). Thereafter, the hair bundle can be set to be curled by, for example, rolling up the hair holder T.

According to the hair inserter 301 of the ninth embodiment, a hair bundle H is inevitably bended by the slide of the sliding member 303 and it is fixed between the hook 321 and the inner peripheral surface of the upper end portion of the sliding member 303. Compared with a hair inserter that is not designed to bend a hair bundle, the hair inserter of the ninth embodiment is capable of smoothly inserting a hair bundle into a hair holder T without untidily deforming the opening edge of the hair holder T. While the hair bundle H proceeds through the hair holder T, since the hair bundle H hardly slips from the hook 321 and hardly gets out of position, the hair inserter exhibits improved operationality. The hair inserter 301 is especially advantageous in that it is capable of smoothly inserting a hair bundle into a hair holder even when the opening of the hair holder is not designed to have high stiffness.

Furthermore, a reaction force is hardly produced during insertion of the hair bundle into the hair holder T so that the hair inserter 301 is easy to draw from the hair holder T. In case where a hair bundle is caught on a loop-shaped hair catching part, the hair bundle must be transferred from one hand to the other after it is passed through the loop. According to the ninth embodiment, in contrast, since a hair bundle is caught on the hook-shaped hair catching part 321, there is no need to shift the hair bundle H from one hand to the other. In addition, since the outer circumference of a cross-section of the hair inserter 301 and the inner circumference of a cross-section of the hair holder T are in a specific ratio, moderate resistance against insertion is exerted while the hair inserter 301 passes through the hair holder T. As a result, the hair holder T is easy to handle, hardly slipping down during the insertion of the hair holder 301 therethrough.

Still other embodiments of the hair inserter according to the present invention will be described only with reference to differences from the ninth embodiment shown in FIG. 28. To those particulars that are not described, the description given to the ninth embodiment applies. The hair inserters according to the embodiments described hereunder are capable of easily inserting a hair bundle into a hair holder similarly to the one of the ninth embodiment.

Figure 31A:
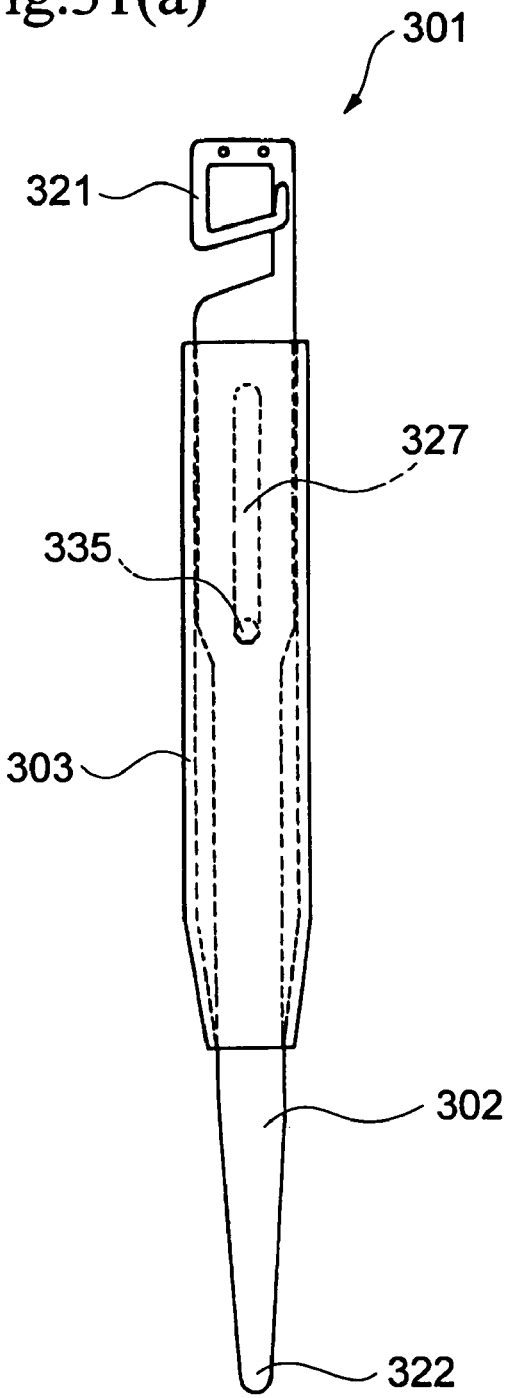
FIG. 31(*a*) and FIG. 31(*b*) are front views of a hair inserter according to a tenth embodiment of the present invention, in which FIG. 31(*a*) shows the state with the hook exposed, and FIG. 31(*b*) the state with the hook enclosed in a sliding member.
Figure 31B:
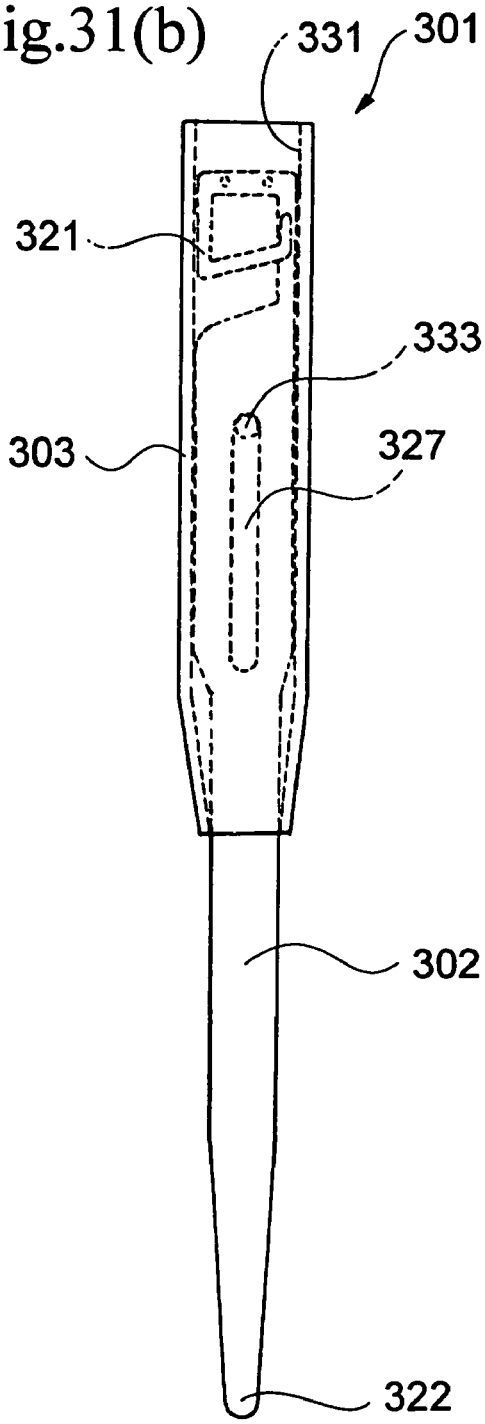

A hair inserter according to a tenth embodiment of the present invention has a main body 302 and a sliding member 303, and the main body 302 passes through the sliding member 303 as shown in FIGS. 31(*a*) and 31(*b*). The main body 302 is a plate-like member tapered to the lower end thereof. The plate-like member has an elongated hole 327 bored in its lengthwise middle portion along the longitudinal direction of the main body 302. As illustrated in FIG. 31(*a*), the hair catching part 321 of the main body 302 is a hook with its tip in contact with other part of the hook.

The sliding member 303 has a sliding pin 335 slidable in the elongated hole 327 of the main body 302. Accordingly, the sliding member 303 is movable toward the main body's lower end 322 until the sliding pin 335 meets the lower end of the elongated hole 327 as shown in FIG. 31(*a*) and is movable toward the hook 321 until the sliding pin 335 reaches the other end of the elongated hole 327 as shown in FIG. 31(*b*).

Figure 32A:
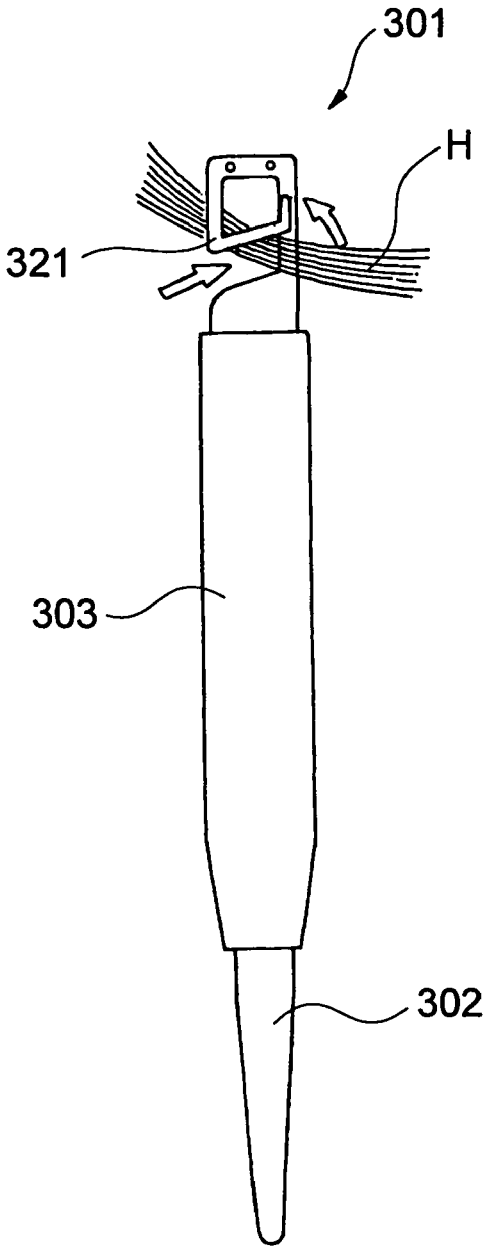
FIG. 32(*a*) and FIG. 32(*b*) are front views showing usage of the hair inserter according to the tenth embodiment, illustrating in sequence the way of fixing a hair bundle to the hook.
Figure 32B:
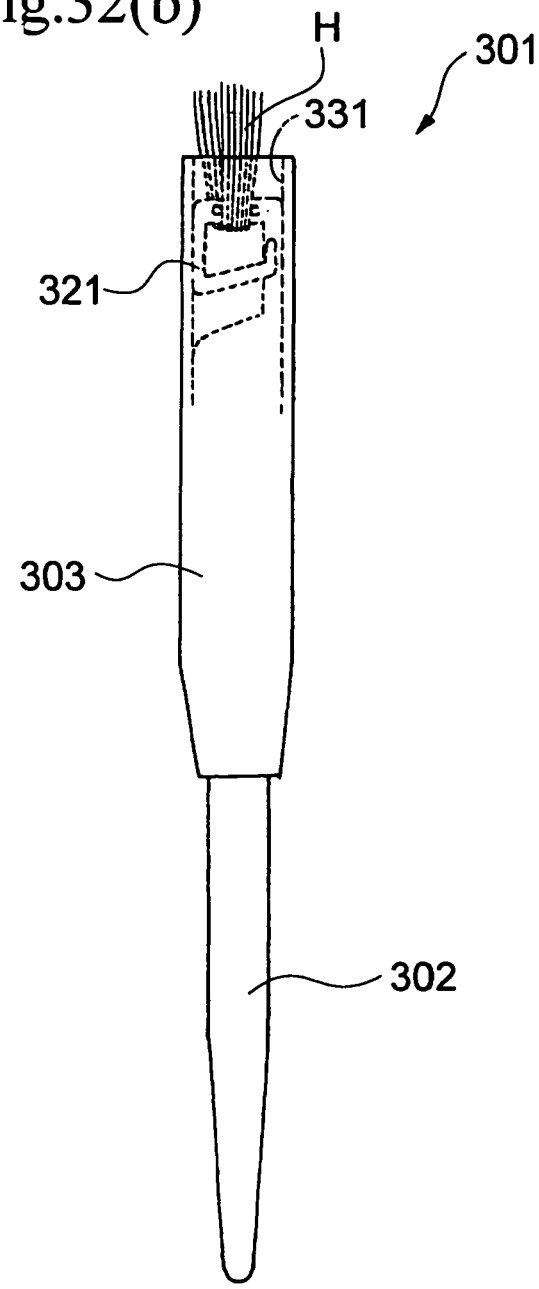

According to the hair inserter 301 of the tenth embodiment, a hair bundle H can be slid along the tip of the hook 321 and thereby caught on the hook 321 as shown in FIG. 32(*a*). In this state, the sliding member 303 is slid toward the hook 321 to fix the hair bundle H caught on the hook 321 between the hook 321 and the inner peripheral surface 331 in the upper end portion of the sliding member 303.

The hair inserter 301 of the tenth embodiment having the hair bundle H fixed therein can be used in the same manner as described with respect to the ninth embodiment as shown in FIG. 28 to produce the same effects as obtained in the ninth embodiment in inserting the hair bundle H in a hair holder T. Because the tip of the hook 321 is in contact with the other part of the hook 321, a hair bundle can be handled easier than with the hair inserter of which the hair catching part 321 is a usual hook. Besides, the hair inserter of the tenth embodiment is simple in structure.

The form of the hair catching part of the main body is not limited to a hook as in the ninth embodiment of FIG. 28 or a hook with its tip in contact with other part of the hook as in the tenth embodiment of FIG. 31 and the form of the hair catching part may be a loop.

Figure 33A:
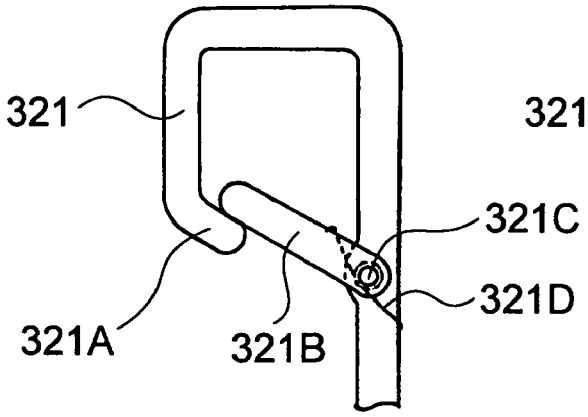
FIG. 33(*a*), FIG. 33(*b*), and FIG. 33(*c*) are front views of a hook according to a modification of the tenth embodiment, illustrating in sequence the way of catching a hair bundle on the hook.
Figure 33B:
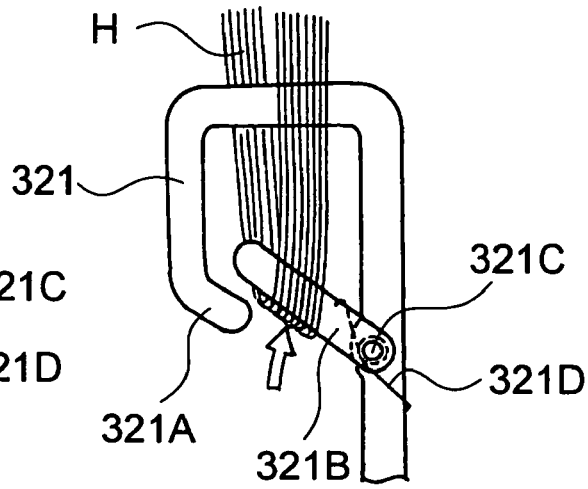
Figure 33C:
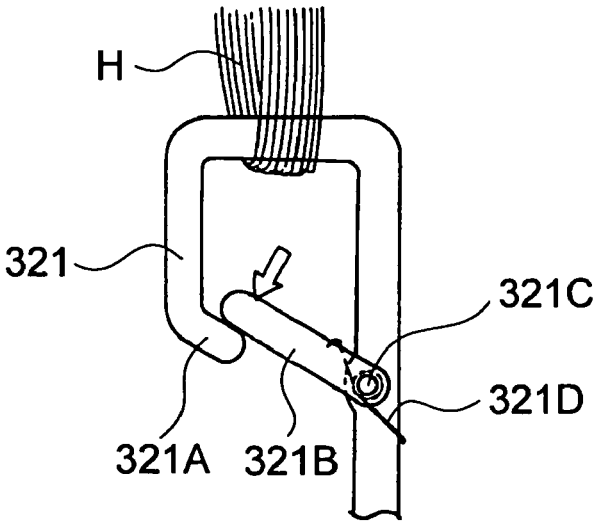

The hair catching part can also be designed as shown in FIGS. 33(*a*), 33(*b*), and 33(*c*). The hair catching part 321 shown in FIG. 33(*a*) is composed of a hook 321A and a safety latch 321B, i.e., a bar connecting the shank of the hair catching part 321 and the tip of the hook 321A. The safety latch 321B is pivotably fixed at a pivot axis 321C. A torsion spring 321D formed by coiling wire is set with one end fixed to the latch 321B, the coil around the pivot axis 321C, and the other end to the shank of the hair catching part 321. The safety latch 321B is always urged toward the outside of the hair catching part 321 as indicated by the arrow in FIG. 33(*c*).

Before use, the hair catching part 321 is a latch-closed hook (loop) as in FIG. 33(*a*). By pushing the safety latch 321B inward, a hair bundle H can be caught on the hair catching part 321 as shown in FIGS. 33(*b*) and 33(*c*). After that, the latch 321B returns to its original position (the position at which it is in contact with the tip of the hook) by the urging force of the spring 321D. Therefore, the hair bundle H can easily be caught on the hair catching part 321 and, after that, the hair catching part 321 forms a loop, which makes handling of the hair bundle H easier.

The sliding member of the hair inserter of the present invention is not limited to those having a round cross-section, provided that it is slidable in the longitudinal direction of the main body and capable of enclosing the hair catching part in its upper end portion. For instance, the sliding member may have a cross-section like the one of a structure composed of a pair of plate-like members bonded together at both of their side edges, or the sliding member may have a polygonal cross-section, e.g., a hexagonal or heptagonal cross-section.

Figure 36A:
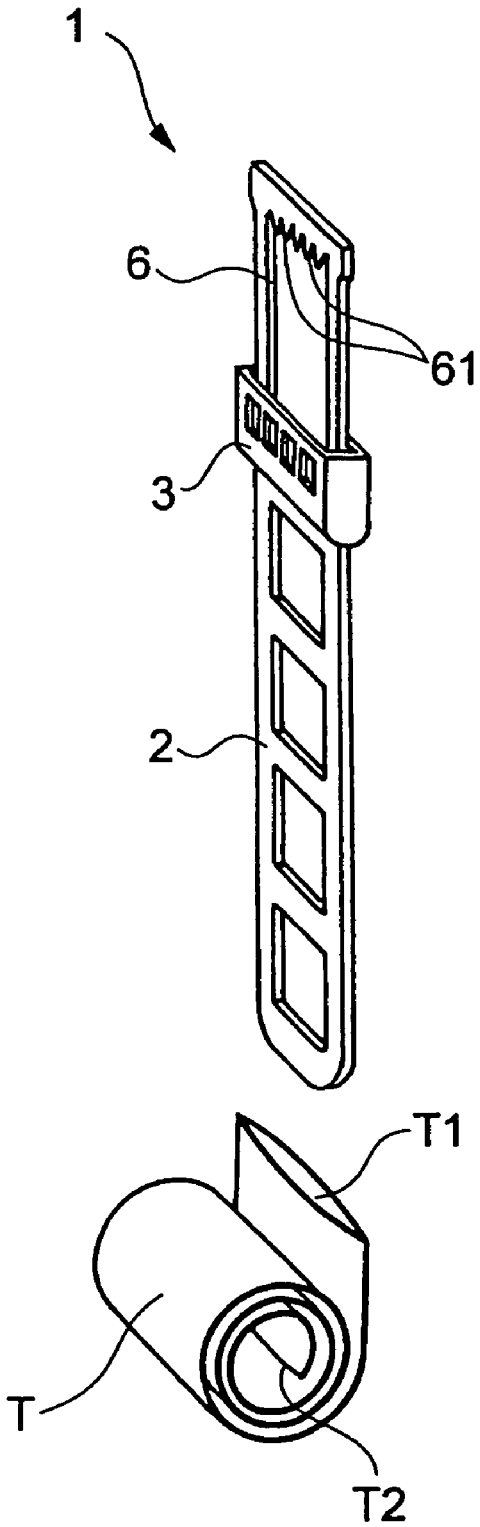
FIG. 36(*a*) and FIG. 36(*b*) are perspectives of a hairdressing tool consisting of the hair holder shown in FIG. 34 and the hair inserter shown in FIG. 1, illustrating in sequence the way of passing the hair inserter through the hair holder.
Figure 36B:
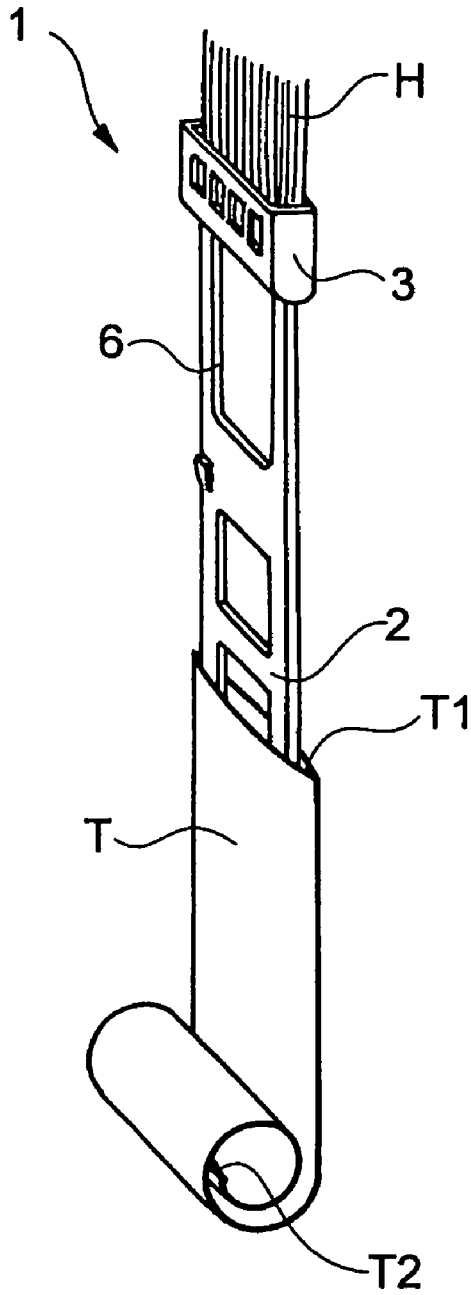
Figure 37A:
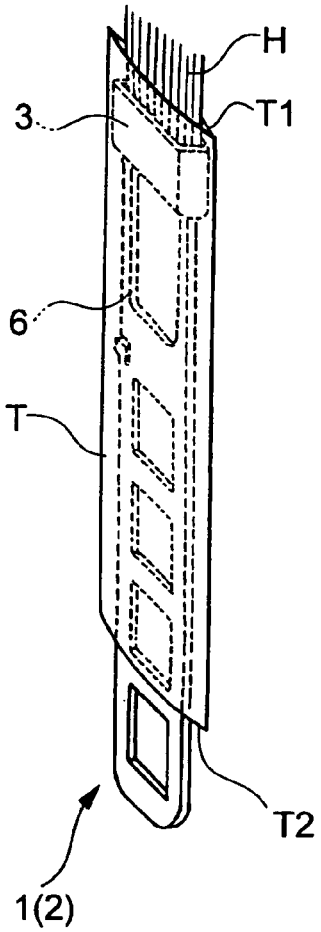
FIG. 37(*a*), FIG. 37(*b*), and FIG. 37(*c*) are perspectives showing the way of passing the hair inserter through the hair holder subsequent to the state of FIG. 36(*b*).
Figure 37B:
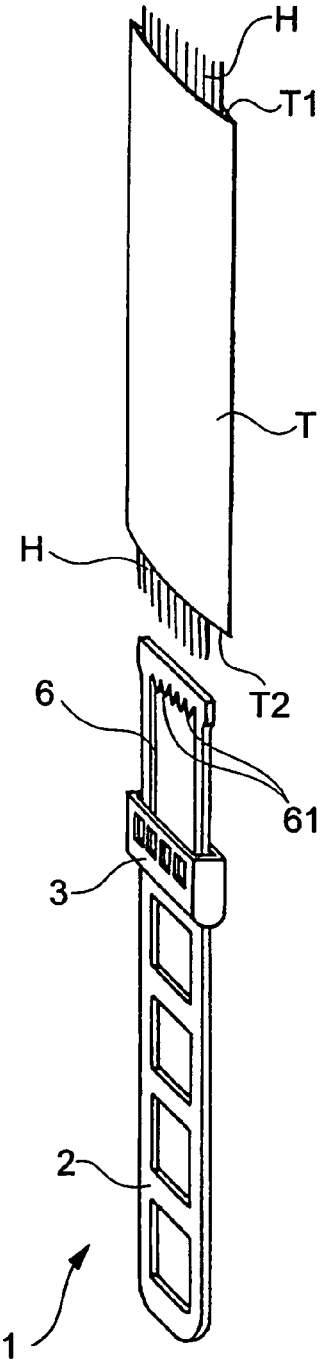
Figure 37C:
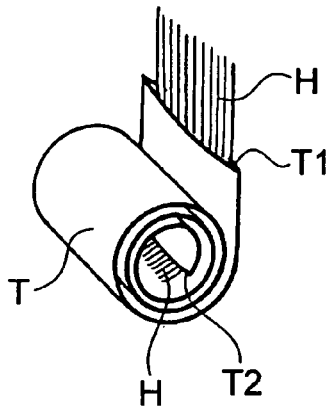

Now, the hairdressing tool of the present invention will be described based on its preferred embodiment with reference to the accompanying drawings. As illustrated in FIGS. 36 and 37, the hairdressing tool of the present embodiment is a combination comprising (1) a hair holder T having a flat tube made of a sheet in such a design that a hair bundle H can be inserted from an opening at one end thereof toward an opening at the other end thereof and (2) a hair inserter 1 for inserting a hair bundle H into the hair holder T. The hair holder T is previously set so as to keep itself in a prescribed rolled state. The hair inserter 1 is passed through the tube from the opening at one end to the opening at the other end and the tube is substantially straightened by the hair holder.

The hair holder T of the hairdressing tool of the present embodiment will be described in more detail. The hair holder T is constituted of a tube having an opening T1 at one end (hereinafter referred to as an upper opening T1) and an opening T2 at the other end (hereinafter referred to as a lower opening T2). The tube is made of two rectangular sheets joined together along their two long side edges. The size of the hair holder T is selected appropriately according to the length of hair, the section of hair to be curled, and the volume of hair to be inserted.

Figure 34A:
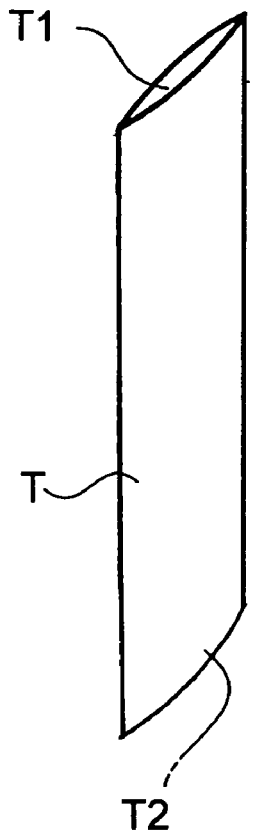
FIG. 34(*a*), FIG. 34(*b*), and FIG. 34(*c*) are perspectives of a hair holder used in an embodiment of the hairdressing tool of the present invention, wherein FIG. 34(*a*) illustrates the stretched state, and FIGS. 34(*b*) and 34(*c*) show in sequence the rolled state.
Figure 34B:
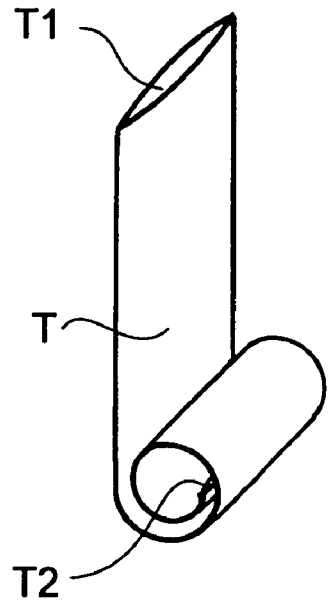
Figure 34C:
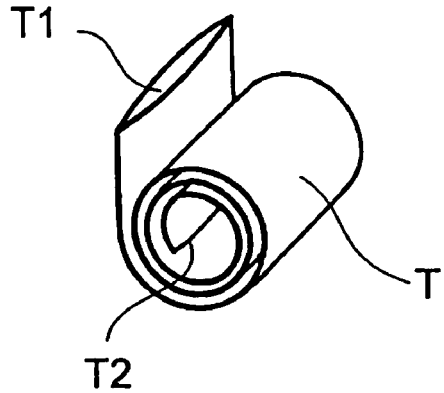

The tube of the hair holder T has been set by prescribed means so as to roll itself up and keep the rolled state. Therefore, when the tube is straightened flat in its length direction by a force as in FIG. 34(*a*) and the force is eliminated from the tube, the tube spontaneously rolls itself up to restore its rolled state as depicted in FIGS. 34(*b*) and 34(*c*).

In order to set the hair holder T into a roll shape, it is convenient to use an elastically deformable material cut to shape and size as a sheet material for the hair holder T. The elastically deformable material includes polyethylene terephthalate, polypropylene, polystyrene, and polyacrylonitrile. A tube made of such an elastically deformable material can be set into a roll by rolling up the tube, fixing the rolled state by certain means, and heating the tube at a prescribed temperature.

According to the above-described hair holder T, after a hair bundle is inserted in the above-described hair holder T and the tube turns into the unrolled state, it rolls itself up spontaneously by releasing the unrolled state. Therefore, the hair holder T of the present embodiment needs no rolling operation. The hair holder T has another advantage that means for maintaining the rolled state, such as clips, is unnecessary.

The hair inserter 1 of the hairdressing tool of the present embodiment is the one shown in FIG. 1. The hair inserter preferably has a Taber stiffness of 15 m·N·m or higher, still preferably 30 m·N·m or higher, in the longitudinal direction.

Figure 35:
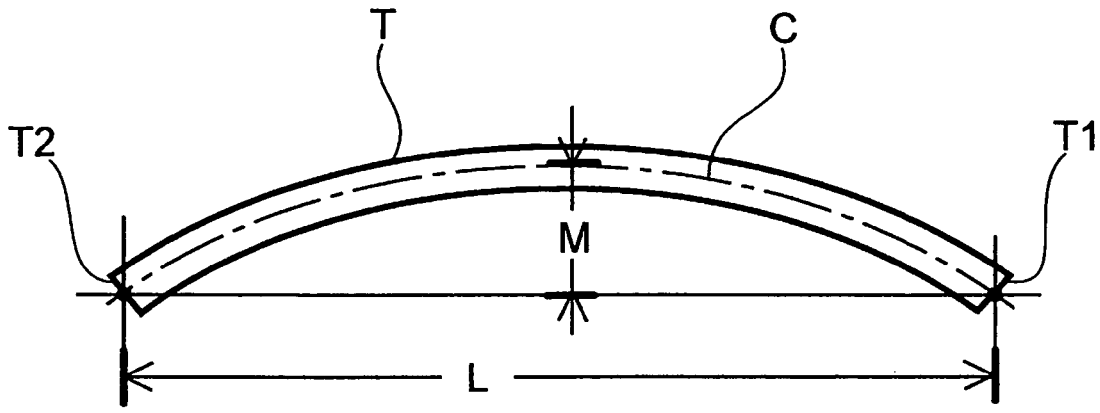
FIG. 35 is a diagram defining the "substantially straightened state" as referred to with respect to the hairdressing tool of the present invention.

According to the hair dressing tool of the present embodiment, the hair inserter 1 has a high stiffness and is capable of converting an unrolled state into a substantially straightened state of the tubular hair holder T when it is inserted into the tube in the direction of from the upper opening T1 toward the lower opening T2. The expression "substantially straightened state" is intended to include not only a state with geometric straightness but a state with such curvature that does not affect insertability of hair. This is explained more specifically by referring to a side view of the tube T shown in FIG. 35. Where the centerline C in the thickness of the tube T is taken as a base line, the "substantially straightened state" includes a state in which the ratio of the maximum height M of the centerline C from the line connecting the openings T1 and T2 to the shortest distance L between the openings T1 and T2 falls within a range of 0 to 0.35.

The hairdressing tool comprising the hair holder T shown in FIG. 34 and the hair inserter 1 shown in FIG. 1 is used as follows. FIGS. 3, 36, and 37 are referred to. As shown in FIG. 3(*a*), the sliding member 3 is positioned lowest. A hair bundle H is caught on the comb teeth 61 of the hair catching part 6 as shown in FIG. 3(*b*). The sliding member 3 is slid up as shown in FIG. 3(*c*) to fix the hair bundle H, which is caught on the hair catching part 6, between the hair catching part 6 and the sliding member 3. The hair inserter 1 having the hair bundle H fixed is then put into the upper opening T1 of the hair holder T with the lower end of the plate-like member 2 first as shown in FIGS. 36(*a*) and 36(*b*). Because the hair inserter 1 of the present embodiment has a sufficient high stiffness, the hair inserter 1 substantially straightens the rolled hair holder T as it proceeds inside the tube of the hair holder T as illustrated in FIG. 36(*b*).

The hair inserter 1 is further inserted through the hair holder T until the leading end of the plate-like member 2 emerges from the lower opening T2 of the hair holder T. In this state, the whole of the hair holder T is substantially straightened by the hair inserter 1 as depicted in FIG. 37(*a*). The hair inserter 1 is then drawn from the lower opening T2 of the hair holder T as shown in FIG. 37(*b*). For easier insertion of the hair, it is preferred that the hair inserter be previously set in the hair holder, and the hair is caught and fixed on the hair inserter in this state and then the hair is led to the hair holder by drawing out the hair inserter from the hair holder.

After the hair inserter 1 is passed through the hair holder T from the upper opening T1 to the lower opening T2 in this manner, the hair bundle H is held in the hair holder T with its tip slightly sticking out of the lower opening T2, and the hair holder T spontaneously rolls itself up by the previous set as shown in FIG. 37(*c*). As a result, the hair bundle can be curled in a prescribed style.

With the hairdressing tool of the present embodiment, a user can pass the hair inserter 1 having a hair bundle H fixed therein through the hair holder T having been set to keep a prescribed rolled up state from the opening T1 to the opening T2 while the hair inserter 1 is straightening the hair holder T. Therefore, a user can easily put the hair inserter 1 through the hair holder T and smoothly pass the hair inserter 1 through the hair holder T.

The hairdressing tool of the present invention is not limited to the above-described embodiment, and various modifications can be made thereto without departing from the spirit and scope of the present invention. While the hair inserter of that embodiment is designed to have a high stiffness so that it may substantially straighten a tubular hair holder as it proceeds from one opening to the other opening of the hair holder, the hair inserter of the hairdressing tool of the invention is not limited to that design as long as it is capable of substantially strengthening a tubular hair holder.

The hair inserter of the hairdressing tool of the present invention is not limited to those having a plate-like member as in the aforesaid embodiments and may have a member with a circular cross-section, a member with a triangular cross-section or a member with a polygonal cross-section including a rectangular cross-section. The rolled shapes of the hair holder of the hairdressing tool of the present invention are not limited to the shapes as in the above-mentioned particular embodiment and include various shapes, such as an accordion-folded shape, a zig zag shape, and a spiral shape, which are selected according to the purpose. The tube of the hair holder is not limited in method of fabrication. For instance, edges of a sheet or sheets are joined by sewing or fusion bonding or with an adhesive, or the tube may be a flat tube obtained by extrusion molding or the like.

The hair inserter of the present invention is not limited to the aforementioned embodiments, and various modifications can be made thereto without departing from the spirit and scope of the invention. The constituent elements of the above-described hair inserters are interchangeable among different embodiments unless such modifications are deemed to be a departure from the scope of the present invention.

In curling a hair bundle by use of the hair inserter according to the aforementioned embodiments, it is preferable to perm the hair using a permanent wave preparation. An embodiment of a method of permanent waving of the present invention is described below. According to this embodiment, a hair bundle is inserted into a hair holder by using a hair inserter of the present invention, for example, the one shown in FIG. 1, and the hair holder containing the hair bundle is rolled up. In this state, a permanent waving preparation is applied to the hair holder (not diagrammatically illustrated). By so doing, the permanent wave preparation is diffused throughout the hair bundle. After an elapse of a given time, the hair bundle is removed from the hair holder, and the hair bundle is washed to complete the permanent waving. Where the hair holder is a tube impermeable to a permanent waving preparation, the permanent waving preparation is fed inside of the hair holder through the opening and the permanent waving preparation is diffused throughout the hair bundle.

Hair inserters were evaluated in terms of insertability into a hair holder. The results of evaluation are shown below.

EXAMPLES

An evaluation test was carried out using a 4 cm wide and 25 cm long hair holder made of two sheets of polyethylene nonwoven fabric (thickness: 250 μm) and having a Taber stiffness of 0.09 mN·m as a whole and a hair inserter made of a 1 mm thick sheet of low-density polyethylene (LDPE) and having a Taber stiffness of 17.2 mN·m.

The hair inserter was inserted into the hair holder, and the insertability was graded as follows.

A: Smoothly insertable

B: Insertable but without smoothness

C: Hardly insertable

Comparative Example 1

A hair inserter made of a 250 μm thick polyethylene film having a Taber stiffness of 1.5 mN·m was inserted into the same hair holder as used in Example to grade the insertability in the same manner as in Example.

Comparative Example 2

A hair inserter fabricated of nylon yarn (diameter: 1 mm) and having a Taber stiffness of 1.6 mN·m was inserted into the same hair holder as used in Example to evaluate the insertability in the same manner as in Example.

TABLE 1

| | Hair Inserter | Stiffness (Taber) of Hair Inserter (mN · m) | Stiffness of Hair Inserter/ Stiffness of Hair Holder | Space Forming Member | Insert ability |
|---|---|---|---|---|---|
| Example | LDPE sheet (1 mm thick) | 17.2 | 191 | yes | A |
| Comp. Example 1 | polyethylene film (250 μm thick) | 1.5 | 17 | no | C |
| Comp. Example 2 | nylon yarn (1 mm diameter) | 1.6 | 18 | no | C |

As is apparent from the results of evaluation shown in Table 1, where the stiffness ratio (hair inserter's stiffness/hair holder's stiffness) is small, smooth insertion cannot be assured. With a high stiffness ratio, insertion can be carried out smoothly.

INDUSTRIAL APPLICABILITY

The hair inserter of the present invention makes it possible to insert a hair bundle into a flat tubular hair holder smoothly and easily.

With the hairdressing tool of the present invention, a hair inserter can easily be put into a hair holder and easily be passed through the hair holder. Because the hair holder can be straightened, a hair bundle can smoothly be inserted into the hair holder.

According to the permanent waving method of the present invention, hair can easily be permanent waved by the use of the above-described hair inserter.

The invention claimed is:

1. A hair device, comprising:

a hair holder comprising a flat tube made of a sheet in such a design that a hair bundle can be inserted from an opening at one end of the tube toward an opening at an other end of the tube; and a hair inserter to insert the hair bundle into the hair holder, the hair inserter comprising a long main body having, at one end portion thereof, a hair catching part including a plurality of teeth on an inner circumferential face of one of the sides of the hair catching part to catch the hair bundle, and the long main body is smoothly inserted with a hair bundle caught on the hair catching part thereof into the tube from the opening at the one end toward the opening at the other end and a space forming member, slidably coupled with the long main body, that slides from a first position below the hair catching part to a second position extending above an outer circumferential face of the one of the sides of the hair catching part that includes the plurality of teeth to cover the plurality of teeth to hold the hair bundle around the teeth.

2. The hair device according to claim 1, wherein the hair inserter is stiffer than the hair holder.

3. The hair device according to claim 1, wherein the space-forming member is thicker and wider than the hair catching part, and the space-forming member is slidable in a longitudinal direction of the hair inserter.

4. The hair device according to claim 1, wherein the hair catching part includes an upper stopper positioned adjacent to the plurality of teeth, and in the second position, the space forming member is fixed in place by the upper stopper to completely cover the plurality of teeth to lock the hair bundle around the teeth.

* * * * *